US008245679B2

(12) United States Patent
Morishima

(10) Patent No.: US 8,245,679 B2
(45) Date of Patent: Aug. 21, 2012

(54) VARIABLE VALVE TIMING APPARATUS

(75) Inventor: Shingo Morishima, Toyota (JP)

(73) Assignee: Denso Corporation, Kariya (JP)

( * ) Notice: Subject to any disclaimer, the term of this patent is extended or adjusted under 35 U.S.C. 154(b) by 380 days.

(21) Appl. No.: 12/582,886

(22) Filed: Oct. 21, 2009

(65) Prior Publication Data

US 2010/0095920 A1 Apr. 22, 2010

(30) Foreign Application Priority Data

| | | |
|---|---|---|
| Oct. 22, 2008 | (JP) | 2008-272378 |
| Oct. 22, 2008 | (JP) | 2008-272379 |
| May 7, 2009 | (JP) | 2009-112988 |
| May 25, 2009 | (JP) | 2009-125739 |

(51) Int. Cl.
*F01L 1/34* (2006.01)

(52) U.S. Cl. ..... 123/90.17; 123/90.15; 464/160

(58) Field of Classification Search ..... 123/90.15, 123/90.17; 464/160
See application file for complete search history.

(56) References Cited

U.S. PATENT DOCUMENTS

| | | | | |
|---|---|---|---|---|
| 4,817,964 | A | 4/1989 | Black, Jr. | |
| 7,051,688 | B2 * | 5/2006 | Lancefield | 123/90.15 |
| 2005/0103293 | A1 | 5/2005 | Lancefield | |

FOREIGN PATENT DOCUMENTS

| | | | |
|---|---|---|---|
| JP | 58-97969 | | 7/1983 |
| JP | 61-200957 | | 12/1986 |
| JP | 62-71473 | | 5/1987 |
| JP | 64-27577 | | 2/1989 |
| JP | 3-41274 | | 4/1991 |
| JP | 04-131517 | | 5/1992 |
| JP | 09-242882 | | 9/1997 |
| JP | 10-132089 | | 5/1998 |
| JP | 2004060849 | A * | 2/2004 |
| JP | 2007-113786 | | 5/2007 |
| JP | 2008-031905 | | 2/2008 |
| JP | 2008-051093 | | 3/2008 |

OTHER PUBLICATIONS

Japanese Office Action dated Sep. 7, 2010 for corresponding Japanese Application No. 2009-125739 with English Translation.

* cited by examiner

*Primary Examiner* — Ching Chang
(74) *Attorney, Agent, or Firm* — Nixon & Vanderhye PC

(57) ABSTRACT

A variable valve timing apparatus has a case, a rotor, and a magneto-rheological fluid. The magneto-rheological fluid gives variable braking force to the rotor. The rotor is connected with a phase adjusting mechanism. The phase adjusting mechanism adjusts a phase of an internal combustion engine according to braking force. A sealing device is disposed between the case and the rotor. In one embodiment, the sealing device has a magnet and a plurality of flux guide members. In other embodiment, a diaphragm which acts as a damper mechanism for absorbing an internal pressure change is disposed on a fluid chamber in which the magneto-rheological fluid is kept.

25 Claims, 18 Drawing Sheets

VARIABLE VALVE TIMING APPARATUS

CROSS REFERENCE TO RELATED APPLICATION

This application is based on Japanese Patent Applications No. 2008-272378 filed on Oct. 22; 2008, 2008-272379 filed on Oct. 22, 2008; 2009-112988 filed on May 7, 2009; and 2009-125739 filed on May 25, 2009, and the contents of which are incorporated herein by reference in its entirety.

FIELD OF THE INVENTION

The present invention relates to a variable valve timing apparatus for adjusting valve timing of an internal combustion engine.

BACKGROUND OF THE INVENTION

Conventionally, a variable valve timing apparatus which adjusts a relative angular phase between a crankshaft and a camshaft according to a braking torque generated by an actuator is known. The relative angular phase may be called as an engine phase indicating a valve operating timing. One of the variable valve timing apparatus is disclosed in JP 2008-51093A. The apparatus generates a braking torque by a fluidic actuator for adjusting the engine phase.

In detail, the apparatus in JP 2008-51093A has an actuator for generating a braking torque. The actuator is provided with a case, a rotor arranged in the case, a magneto-rheological fluid in contact with the rotor, and an electromagnetic device which adjusts a viscosity of the magneto-rheological fluid. The rotor has a shaft which penetrates the case and extends between an inside and outside of the case. The rotor is engaged with a phase adjusting mechanism. According to this apparatus, the rotor generates a braking torque according to the adjusted viscosity of the magneto-rheological fluid. The braking torque is transmitted to the phase adjusting mechanism. As a result, the phase adjusting mechanism adjusts the engine phase according to the braking force.

One technical problem of this kind of variable valve timing apparatus is that the magneto-rheological fluid which causes instability of various characteristics.

One technical problem of this kind of variable valve timing apparatus is a leak of the magneto-rheological fluid. A leak may change generating characteristics and input characteristics of the braking torque. In addition, a leak may affect adjusting characteristics of the engine phases and generates undesirable change on the characteristics.

One technical problem of this kind of variable valve timing apparatus is a pressure change in a fluid chamber where the magneto-rheological fluid is kept. Durability of the apparatus may be reduced if the pressure change excessively increased. In addition, the pressure change is not stable since the pressure change is generated according to an environmental temperature or a heat generation by a braking action.

SUMMARY OF THE INVENTION

It is an object of the present invention to provide an improved variable valve timing apparatus.

It is another object of the present invention to provide a variable valve timing apparatus which is capable of suppressing change of adjusting characteristics resulting from a magneto-rheological fluid.

It is a still another object of the present invention to provide a variable valve timing apparatus which is capable of suppressing a leak of a magneto-rheological fluid.

It is a still another object of the present invention to provide a variable valve timing apparatus which is capable of suppressing both a leak of a magneto-rheological fluid, and problem resulting from friction.

It is a still another object of the present invention to provide a variable valve timing apparatus which is capable of suppressing a pressure change in a fluid chamber which keeps a magneto-rheological fluid.

It is a still another object of the present invention to provide a variable valve timing apparatus which is capable of suppressing both a leak of a magneto-rheological fluid, and degradation of a magneto-rheological fluid.

According to one embodiment of the invention, a sealing device is provided with a magnet which generates magnetic flux. The magnet is supported on one of a case or a rotor. The sealing device has a plurality of flux guides. Each flux guide is formed and arranged in the case in an annular shape extending along a rotating direction of the rotor. The flux guide may be formed in an annular ring shape surrounding a boss part of the rotor. Each flux guide is supported on one of the case and the rotor. The plurality of flux guides define a plurality of guide gaps which guide magnetic flux generated by the magnet. The guide gaps are arranged along an axial direction between an inside and an outside of the case. The guide gaps are arranged in a multi stage manner from the inside to the outside of the case. The plurality of guide gaps are formed between the case and the rotor. A magneto-rheological fluid is enclosed in the fluid chamber. The magneto-theological fluid flows into the guide gaps where the magnetic flux is guided in a concentrated manner. The viscosity of the magneto-rheological fluid trapped in the guide gap is increased due to a concentrated magnetic flux. The magneto-rheological fluid is trapped in the guide gap in a film shape spreading between the rotor and the case. Since the plurality of flux guides define a plurality of guide gaps in a multi stage fashion, the magneto-rheological fluid is trapped in those multi stages, and is prevented from leaking to an outside of the case.

According to one embodiment of the invention, a variable valve timing apparatus is provided with a movable member exposed to a fluid chamber by being supported on a case or a rotor in a movable manner for changing a capacity of the fluid chamber by moving according to change of an internal pressure in the fluid chamber. The movable member moves to change the capacity or volume of the fluid chamber in response to change of the internal pressure which is fluctuated by temperature fluctuation.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

A plurality of embodiments of the present invention are explained referring to drawings. Components and parts corresponding to the components and parts described in the preceding description may be indicated by the same reference number and may not be described redundantly. In a case that only a part of component or part is described, other descriptions for the remaining part of component or part in the other description may be incorporated. The embodiments can be partially combined or partially exchanged in some forms which are clearly specified in the following description. In addition, it should be understood that, unless trouble arises, the embodiments can be partially combined or partially exchanged each other in some forms which are not clearly specified.

First Embodiment

Figure 1:
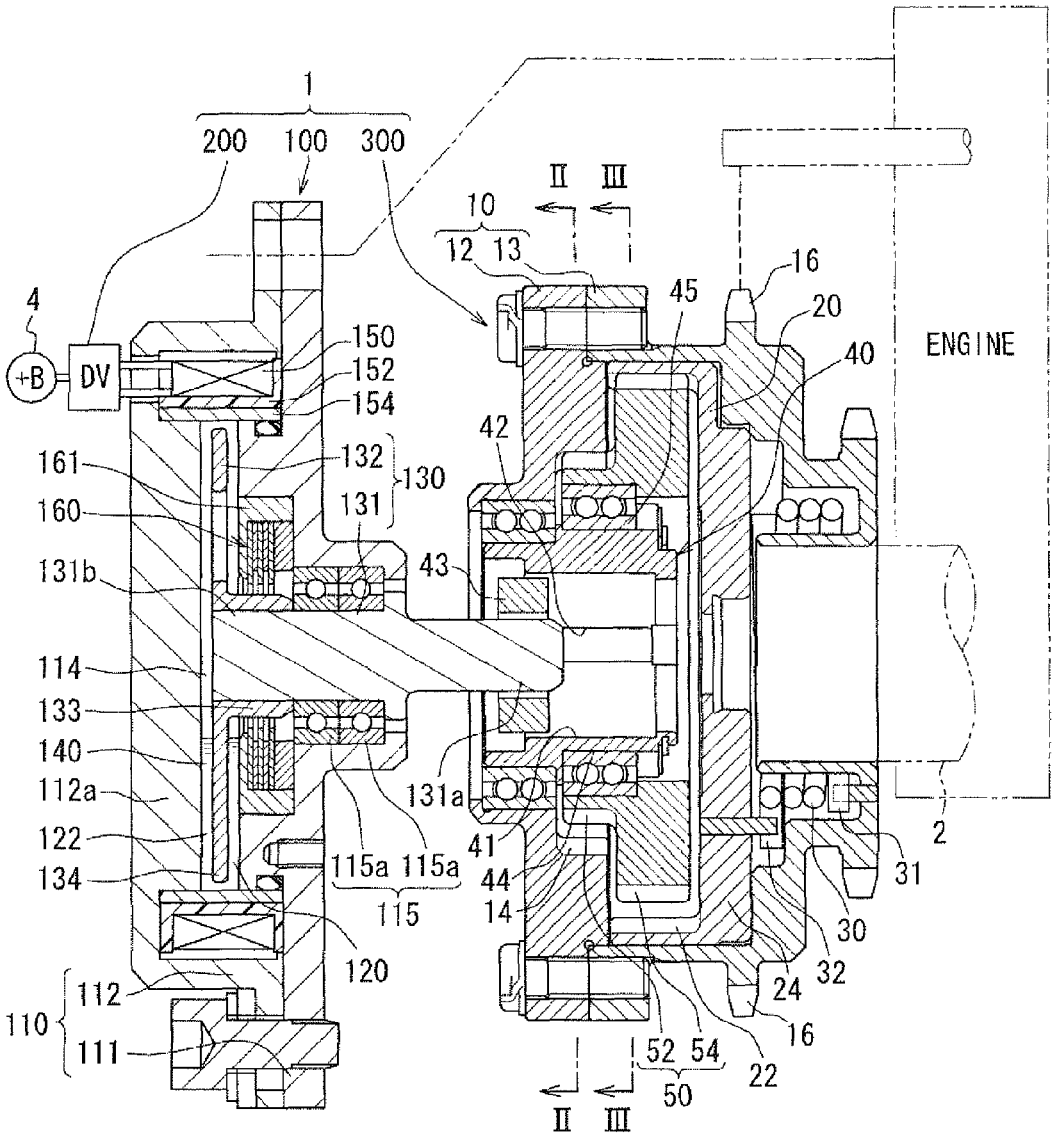
FIG. 1 is a sectional view showing a variable valve timing apparatus according to a first embodiment of the present invention.

FIG. 1 shows the variable valve timing apparatus 1 according to the first embodiment of the present invention. The variable valve timing apparatus 1 adjusts valve timing of valve. The valve is driven in an open position and a close position by a camshaft 2. The camshaft 2 is rotated by torque transmission from the crankshaft of an internal combustion engine. The variable valve timing apparatus 1 is mounted on the engine on a vehicle. The variable valve timing apparatus 1 is installed in a torque transmission train which transmits engine torque to the camshaft 2 from the crankshaft. The camshaft 2 shown in FIG. 1 opens and closes at least one of intake valves among valves of the internal combustion engine. The variable valve timing apparatus 1 adjusts the valve timing of the intake valve. The variable valve timing apparatus 1 in the first embodiment has an actuator 100, a control circuit (DV) 200, and a phase adjusting mechanism 300. The control circuit 200 is a circuit supplying energizing current for generating magnetic flux. The variable valve timing apparatus 1 provides appropriate valve timing for the internal combustion engine by adjusting an engine phase which is a relative angular phase between the camshaft 2 and the crankshaft.

As shown in FIG. 1, the actuator 100 is an electromagnetic type fluid brake. The actuator 100 is provided with a case 110, a brake rotor 130, a solenoid coil 150, and a sealing device 160. The brake rotor 130 generates a braking action. The brake rotor 130 is called as the rotor 130. The case 110 is formed in a hollow shape. The case 110 has a fixing member 111 and a fluid chamber defining member 112. The fixing member 111 is called as a first housing 111. The fluid chamber defining member 112 is called as a second housing 112. The first housing 111 is formed in an annular plate shape, and is made of magnetic materials, such as carbon steel. The first case 111 is fixed to a member on the engine, such as a chain cover. The second housing 112 is formed in a cylindrical shape with a bottom wall, and is made of the same magnetic material as the first housing 111. The second housing 112 is arranged on the same axis with the first housing 111. The second housing 112 is on a side of the first housing 111 opposite to the phase adjusting mechanism 300. The first housing 111 and the second housing 112 are tightened by screws to form the case 110 and to define a fluid chamber 114 therebetween. The rotor 130 is provided as a component including a shaft 131 and a magnetic rotor plate 132 securely fixed each other. The shaft 131 is formed in a shaft shape, and is made of metal, such as chromium-molybdenum steel. The shaft 131 penetrates the case 110 between an inside and an outside. The case 110 has a bearing 115. The bearing 115 is supported on the first housing 111 where the shaft 131 is placed to penetrate the case 110. The shaft 131 is rotatably supported on the bearing 115. The bearing 115 includes two or more radial bearings which have components, including an inner race, an outer race and rolling elements, made of carbon steel etc. The case 110 including the bearing 115 is made of magnetic material which has high-permeability of magnetic flux. One end 131*a* of the shaft 131 extends to the outside of the case 110. The end 131*a* is engaged with the phase adjusting mechanism 300 at the outside of the case 110. Since the phase adjusting mechanism 300 receives the engine torque from the crankshaft, the rotor 130 receives a rotating torque in a counterclockwise direction in FIGS. 2 and 3 from the phase adjusting mechanism 300. As shown in FIG. 1, the magnetic rotor plate 132 is made of, for example, magnetic materials, such as carbon steel. The magnetic rotor plate 132 has a boss part 133 formed in a cylindrical shape and a plate part 134 formed in an annular plate shape. The boss part 133 is disposed on an outer surface of the shaft 131 and fixed on the shaft 131. The boss part 133 is placed next to the bearing 115 on the inside of the case 110. The boss part 133 has an outer diameter that is smaller than an inner diameter of the outer race of the bearing 115. The sealing device 160 is provided on a radial outside of the boss part 133 to provide a fluidic seal between the case 110 and the rotor 130. The plate part 134 is formed on the same axis of the boss part 133. The plate part 134 spreads toward radial outside from the boss part 133. The plate part 134 is accommodated in the fluid chamber 114. The plate part 134 is arranged so that the sealing device 160 is positioned between the plate part 134 and the bearing 115. In the fluid chamber 114, the plate part 134 and the first housing 111 defines a magnetic gap 120. Similarly, the plate part 134 and the bottom wall portion 112*a* of the second housing 112 define a magnetic gap 122. Those magnetic gaps 120 and 122 are provided for giving the braking torque to the rotor 130 via a magneto-rheological fluid 140 trapped in the magnetic gaps 120 and 122. Those magnetic gaps 120 and 122 may be called as braking gaps.

The magneto-rheological fluid 140 is enclosed in the fluid chamber 114 with air. The magneto-rheological fluid 140 is also called the MRF 140. The fluid chamber 114 is partially filled with the MRF 140. The MRF 140 is a kind of functional fluid. The MRF 140 is made of magnetic particles which are suspended form in base liquid. Nonmagnetic material in a liquid form is commonly used as the base liquid for the MRF. For example, oil which is the same kind of lubrication oil for the internal combustion engine may be used as the base liquid. A powdered magnetic material, such as carbonyl iron etc. may be used as the magnetic particles for the MRF 140. Viscosity of the MRF 140 is varied according to a magnetic field intensity applied. In other word, viscosity of the MRF 140 is varied according to a magnetic flux density. Therefore, the MRF 140 demonstrates a characteristic of shearing stress that is increased in proportion to the viscosity. The MRF 140 also demonstrates a characteristic of shearing stress that is increased in inverse proportion to a size of the gap where the MRF 140 exists.

A solenoid coil 150 is a winding of a metal line wound on a radial outside surface of a cylindrical bobbin 152. The solenoid coil 150 is disposed on a radial outside part of the plate part 134 in a coaxial manner. The solenoid coil 150 is supported on the first housing 111 and the second housing 112 via the bobbin 152 and the spacer 154. The solenoid coil 150 is excited by being supplied with electric current. The solenoid generates a magnetic field for adjusting the viscosity of the MRF 140. The magnetic field forms magnetic flux which passes through the first housing 111, the magnetic gap 120, the plate part 134, the magnetic gap 122, and the second housing 112. When the solenoid coil 150 generates the magnetic flux during rotation of the rotor 130, the MRF 140 is attracted and flows into each magnetic gaps 120 and 122, and the MRF 140 provides path for the magnetic flux. A shearing stress proportional to the viscosity of the MRF 140 where the magnetic flux passes acts between components 110 and 130 which come in contact with the MRF 140 in each magnetic gaps 120 and 122. Therefore, the plate part 134 receives the braking torque in the clockwise direction in FIGS. 2 and 3. As a result, the braking torque according to the viscosity of the MRF 140 is applied to the rotor 130 by supplying the magnetic flux by exciting the solenoid coil 150.

FIG. 1 shows a control circuit 200. The control circuit 200 controls current supplied to the solenoid coil 150. The control circuit 200 is mainly constructed by a microcomputer. The control circuit 200 is disposed separately from the actuator 100. The control circuit 200 is electrically connected with the solenoid coil 150 and the battery 4 on the vehicle. During a stop of the engine, the control circuit 200 turned off a current supply to the solenoid coil 150 in response to a turning off an electric power supply from the battery 4. At this time, the solenoid coil 150 does not generate the magnetic flux, and does not generate the braking torque on the rotor 130. On the other hand, during an operation of the engine, the control circuit 200 is supplied with the electric power from the battery 4, and controls an amount of current supply to the solenoid coil 150. As a result, the solenoid coil 150 generates a regulated amount of the magnetic flux which passes through the MRF 140. At this time, variable control of the viscosity of the MRF 140 is carried out. The braking torque applied to the rotor 130 is adjusted by the amount of the current supply to the solenoid coil 150.

As shown in FIG. 1, the phase adjusting mechanism 300 is provided with a planetary gear mechanism and an assisting mechanism. The planetary gear mechanism includes a drive rotor 10, a driven rotor 20, a planetary carrier 40, and a planetary gear 50. The assisting mechanism includes an assisting member 30. The drive rotor 10 includes a gear member 12 and a chain wheel 13 which are formed in cylindrical shapes and are fastened by screws in a coaxial manner. The gear member 12 has a radial inside surface where a drive inner gear 14 is formed. The chain wheel 13 has a radial outside surface where a plurality of gear teeth 16 is formed. The chain wheel 13 is engaged with the crankshaft via the gear teeth 16 and rotated synchronously with the crankshaft. Therefore, the drive rotor 10 is rotated in the counterclockwise direction in FIGS. 2 and 3. As shown in FIG. 1, the driven rotor 20 is formed in a cylindrical shape and is arranged in a radial inside of the chain wheel 13 in a coaxial manner. The driven rotor 20 has a radial outside surface where a driven inner gear 22 is formed. The driven rotor 20 has a radial inside surface where an engaging part 24 is formed. The engaging part 24 is securely fixed on the camshaft 2 by a bolt. The driven rotor 20 is interlocked with the camshaft 2, and is rotated in the counterclockwise direction in FIG. 3. The driven rotor 20 is supported to relatively rotate with respect to the drive rotor 10.

Figure 2:
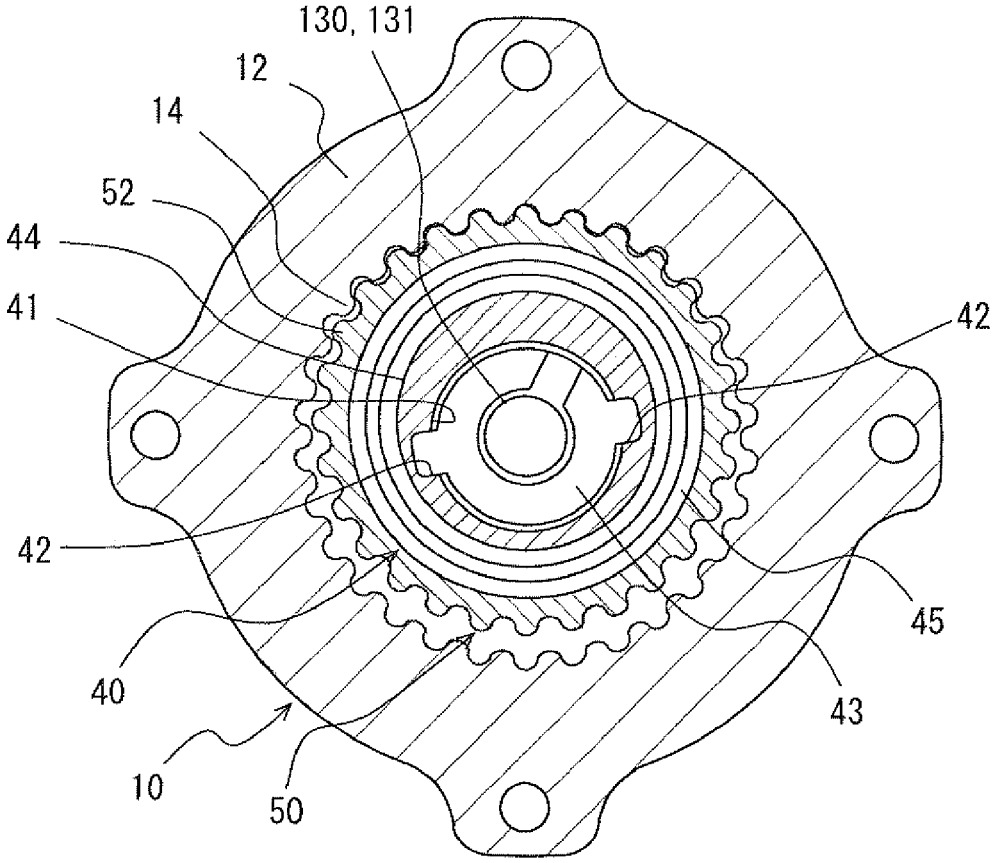
FIG. 2 is a sectional view on the line II-II in FIG. 1.
Figure 3:
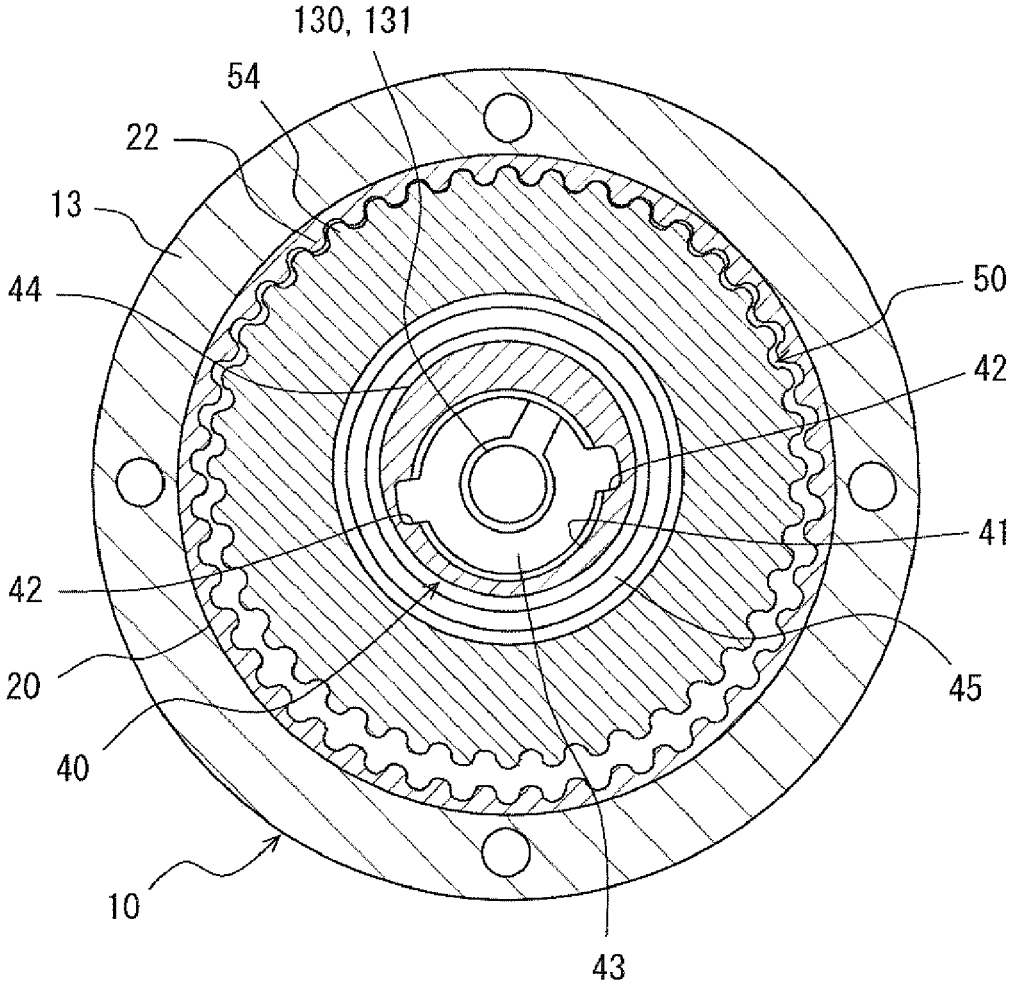
FIG. 3 is a sectional view on the line in FIG. 1.

As shown in FIG. 1, the assisting member 30 consists of a helical torsion spring. The assisting member 30 is coaxially arranged in an inside of the chain wheel 13. The assisting member 30 has one end 31 which is engaged with the chain wheel 13 and the other end 32 which is engaged with the connecting part 24. The assisting member 30 generates assist torque when the assisting member 30 is twisted between the rotors 10 and 20. The assist torque urges and pushes the driven rotor 20 in a retarding direction with respect to the driven rotor 10. As shown in FIGS. 1-3, the planetary carrier 40 is formed in a cylindrical shape as a whole. The planetary carrier 40 has a radial inside surface where a transfer part 41 which receives the braking torque from the rotor 130 is formed. The transfer part 41 is coaxially arranged with the rotors 10 and 20. The transfer part 41 has a plurality of engaging grooves 42 and a connector 43. The connector 43 is engaged with the engaging grooves 42 at keys formed on a radial outside surface, and is engaged with the shaft 131 at a keyed hole formed on a radial inside surface. The planetary carrier 40 and the shaft 131 are engaged in the circumferential direction via the connector 43. The planetary carrier 40 is capable of rotating with the rotor 130. The planetary carrier 40 is capable of rotating relatively with the drive rotor 10. The planetary carrier 40 has a radial outside surface where an eccentric part 44 is formed. The eccentric part 44 is an eccentric shaft formed in a cylindrical shape which has a center axis eccentric to the transfer part 41 by a certain amount. The eccentric part 44 is coaxially arranged in a radial inside of the planetary gear 50. The eccentric part 44 supports the planetary gear 50 via a planetary bearing 45. The planetary carrier 40 supports the planetary gear 50 so that the planetary gear 50 can rotate on the drive inner gear 14 in a sun-and-planet motion. In this embodiment, the sun-and-planet motion is provided by rotating the planetary gear 50 about the eccentric center of the eccentric part 44, and by orbiting the planetary gear 50 about a center of the drive inner gear 14. The planetary gear 50 is formed in a cylindrical shape and is coaxially arranged to the eccentric part 44. That is, the planetary gear 50 is supported in an eccentric manner with respect to the gear parts 14 and 22. In other word, the planetary gear 50 is decenterized from the gears 14 and 22. The planetary gear 50 has a radial outside surface formed in a stepped cylindrical shape. The planetary gear 50 has a drive outer gear 52 and a driven outer gear 54 on the radial outside. The drive outer gear 52 is formed on a smaller diameter part. The driven outer gear 54 is formed on a larger diameter part. The drive outer gear 52 and the driven outer gear 54 are coaxially arranged. The drive outer gear 52 intermeshes with the drive inner gear 14 only at a position where the planetary gear 50 is located by its orbiting motion. The driven outer gear 54 also intermeshes with the driven inner gear 22 only at a position where the planetary gear 50 is located by its orbiting motion.

The phase adjusting mechanism 300 adjusts the engine phase according to a balance of torques among the braking torque on the rotor 130, the assist torque of the assisting member 30, and the fluctuating torque acting on the camshaft 2 during the operation of the engine. In a case that the braking torque is adjusted in a constant value in order to enable the rotor 130 rotates with the drive rotor 10 in the same rotating speed, the planetary carrier 40 does not rotate relatively with respect to the drive inner gear 14. Then, the planetary gear 50 orbits synchronously with both the rotors 10 and 20 without performing relative rotation of the sun-and-planet motion. Therefore, the engine phase is maintained in a constant angular phase. In a case that the braking torque is increased in order to enable the rotor 130 rotates at a rotating speed that is slower than that of the drive rotor 10, the planetary carrier 40 relatively rotates in a retarding direction with respect to the drive inner gear 14. Then, the planetary gear 50 it self rotates by the sun-and-planet motion and orbits on the gears 14 and 22. Therefore, the driven rotor 20 is relatively rotated in an advancing direction with respect to the drive rotor 10. Therefore, the engine phase is advanced. In a case that the braking torque is decreased in order to enable the rotor 130 rotates at a rotating speed that is higher than that of the drive rotor 10, the planetary carrier 40 relatively rotates in an advancing direction with respect to the drive inner gear 14. Then, the planetary gear 50 it self rotates by the sun-and-planet motion and orbits on the gears 14 and 22. Therefore, the driven rotor 20 is relatively rotated in a retarding direction with respect to the drive rotor 10. Therefore, the engine phase is retarded.

Figure 4:
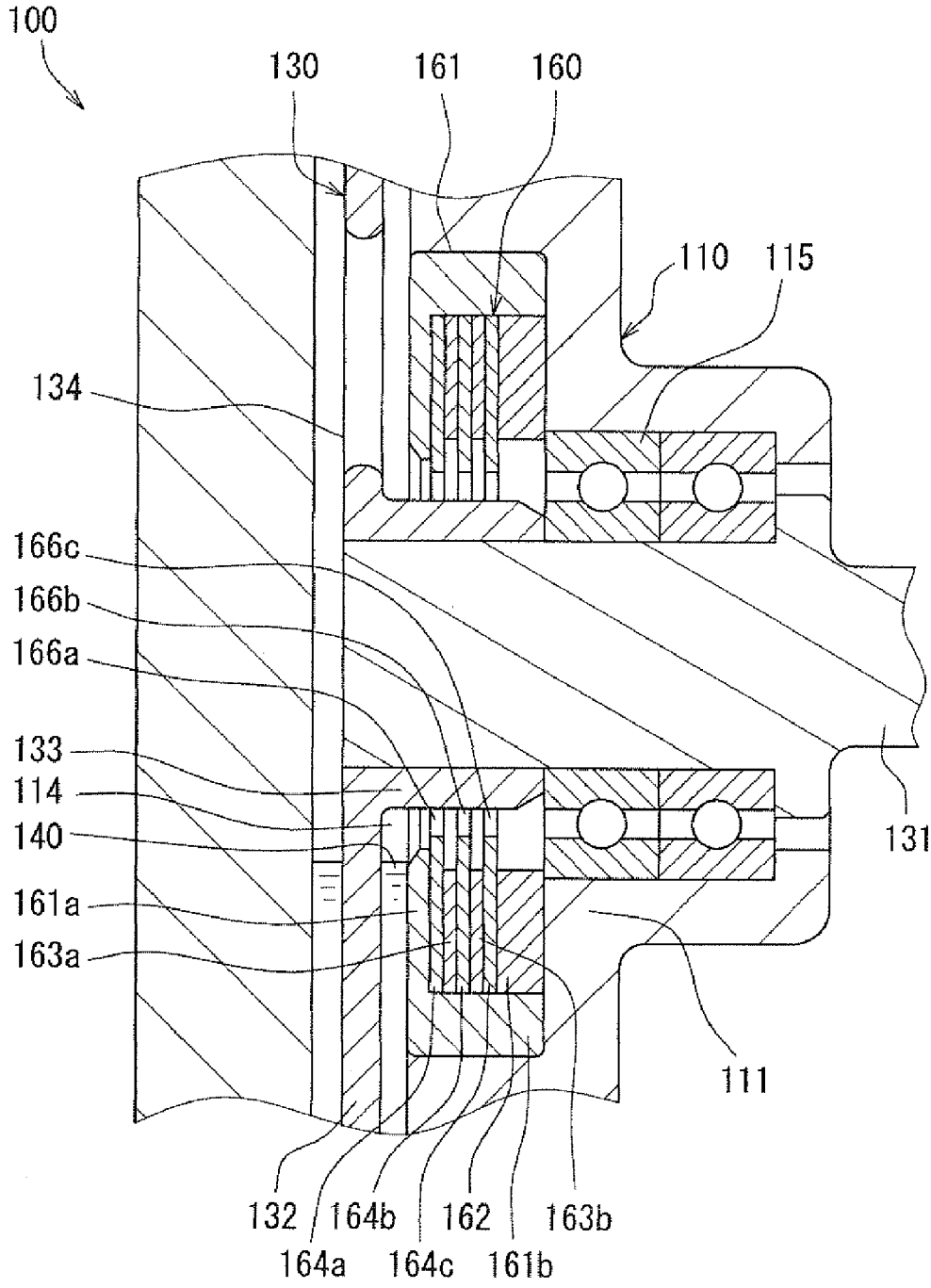
FIG. 4 is a partial enlarged sectional view showing the actuator in FIG. 1.

As shown in FIGS. 1 and 4, the actuator 100 has the sealing device 160. The sealing device 160 keeps the MRF 140 in the fluid chamber 114. The sealing device 160 is covered with a nonmagnetic shield member 161. The sealing device 160 is disposed in the case 110. The sealing device 160 is covered with the nonmagnetic shield member 161. As shown in FIG. 4, the nonmagnetic shield member 161 is formed in a cylindrical shape with a bottom wall, and is made of nonmagnetic material, such as stainless steel. The nonmagnetic shield member 161 is placed on a radial outside to the boss part 133. The nonmagnetic shield member 151 is disposed between the plate part 134 and the bearing 115. The nonmagnetic shield member 161 is disposed and fixed on a radial inside surface of the first housing 111 to place an opening portion facing to the bearing 115. The nonmagnetic shield member 161 holds the sealing device 160 on a radial inside surface. The sealing device 160 is fixed between the nonmagnetic shield member 161 and the bearing 115. The nonmagnetic shield member 161 is supported in the fluid chamber 114 to expose the bottom wall portion 161*a* to an inside of the fluid chamber 114. The bottom wall portion 161*a* is placed to directly expose to the MRF 140 and to face to the plate part 134 in parallel manner. The sealing device 160 has a magnet 162 and a plurality of flux guides 164*a*, 164*b*, and 164*c*, and a plurality of magnetic spacers 163*a* and 163*b*. The magnetic spacer 163*a* is placed between adjacent two of the flux guides 164*a* and 164*b*. The magnetic spacer 163*b* is placed between adjacent two of the flux guides 164*b* and 164*c*. The magnet 162 is a permanent magnet. The magnet 162 is formed in an annular plate shape. The magnet 162 is made of, for example a ferrite magnet etc. The magnet 162 is coaxially arranged with the boss part 133 to extend continuously along an outer circumference of the boss part 133. The magnet 162 is magnetized in the axial direction of the boss part 133 to provide the magnetic poles. One pole is directed to the inside of the case 110. The other pole is directed to the outside of the case 110. The magnet 162 always generates magnetic flux between the magnetic poles. The magnet 162 is fixed on the radial inside surface of the nonmagnetic shield member 161. The magnet 162 has one axial end which comes in contact with the inside surface of the first housing 111. Therefore, the magnet 162 is supported on the case 110 via the nonmagnetic shield member 161. A thickness of the magnet 162 in the axial direction may be set to generate appropriate magnetic flux. For example, the magnet 162 may have the thickness of 2.5 mm.

The flux guides 164*a*, 164*b*, and 164*c* and the magnetic spacers 163*a* and 163*b* are formed in an annular plate shape, and are made of, for example by magnetic materials, such as carbon steel. Each one of the flux guides 164*a*, 164*b*, and 164*c* has a radial inside surface which extends continuously along a circumferential direction of the rotor 130, i.e., the boss part 133. The flux guides 164*a*, 164*b*, and 164*c* are distanced with each other along the axial direction. The magnetic spacers 163*a* and 163*b* defines respective distances between adjacent two of the flux guides 164*a*, 164*b*, and 164*c*. The flux guides 164*a*, 164*b*, and 164*c* and the magnetic spacers 163*a* and 163*b* are securely fixed on a radial inside surface of a peripheral wall part 161*b* of the nonmagnetic shield member 161. The peripheral wall part 161*b* is fixed on the radial inside surface of the first housing 111. The flux guides 164*a*, 164*b*, and 164*c* and the magnetic spacers 163*a* and 163*b* are arranged on a side closer to the fluid chamber 114 than the magnet 162 in an axial direction. In other word, the flux guides and the magnetic spacers are arranged on an opposite side to the first housing 111 and the bearing 115 with respect to the magnet 162. The flux guides are arranged on one side of the magnet with respect to the axial direction. The flux guides 164*a*, 164*b*, and 164*c* and the magnetic spacers 163*a* and 163*b* are supported on the case 110 via the nonmagnetic shield member 161.

In detail, the flux guide 164*a* is placed next to the bottom wall portion 161*a* on the side closer to the outside of the case 110. The magnetic spacer 163*a* is placed next to the flux guide 164*a* on the side closer to the outside of the case 110. The flux guide 164*b* is placed next to the magnetic spacer 163*a* on the side closer to the outside of the case 110. The magnetic spacer 163*b* is placed next to the flux guide 164*b* on the side closer to the outside of the case 110. The flux guide 164*c* is placed next to the magnetic spacer 163*b* on the side closer to the outside of the case 110. The flux guide 164*c* is placed next to the magnet 162 on the side closer to the inside of the case 110. The thickness of the flux guides 164*a*, 164*b*, and 164*c* and the magnetic spacers 163*a* and 163*b* in the axial direction may be set suitably to provide a desirable performance as a magnetic sealing device. For example, the flux guides 164*a*, 164*b*, and

164*c* and the magnetic spacers 163*a* and 163*b* may have the thickness of 0.5 mm that is thinner than that of the magnet 162 by using a press machined plate of a cold roll processed steel plate.

The flux guides 164*a*, 164*b*, and 164*c* and the magnetic spacers 163*a* and 163*b* have the same radial outer diameter. Each of the flux guides 164*a*, 164*b*, and 164*c* has a radial inner diameter that is smaller than a radial inner diameter of each adjacent component 161*a*, 163*a*, 163*b*, and 162. Each of the flux guides 164*a*, 164*b*, and 164*c* has a radial inner diameter that is larger than a radial outer diameter of the boss part 133. Therefore, the radial inside surfaces of the flux guides 164*a*, 164*b*, and 164*c* are placed to protrude inwardly than the adjacent components, such as the magnetic spacers 163*a* and 163*b*. As a result, a plurality of guide gaps 166*a*, 166*b*, and 166*c* are defined between the radial inner surface of the flux guides 164*a*, 164*b*, and 164*c* and the radial outer surface of the boss part 133. The plurality of guide gaps 166*a*, 166*b*, and 166*c* are arranged along the axial direction between a main cavity of the fluid chamber 114 and an inner end of the bearing 115 which is placed on a side closer to the outside of the case 110 than the sealing device 160. Radial distances defined by the guide gaps 166*a*, 166*b*, and 166*c* are defined equal to each other.

Radial distances defined by the guide gaps 166*a*, 166*b*, and 166*c* are defined to be smaller than a thickness of the bottom wall portion 161*a* in the axial direction. The bottom wall portion 161*a* is exposed to the fluid chamber 114 and provides an exposed portion of the nonmagnetic shield member 161. Distances of the guide gaps 166*a*, 166*b* and 166*c* are smaller than a thickness of the nonmagnetic shield member 161. In detail, the distances are smaller than a thickness of the bottom wall portion 161*a*. Therefore, the magnetic flux of the magnet 162 is prevented from leaking to a side of the fluid chamber 114 from the bottom wall portion 161*a*. The magnetic flux of the magnet 162 passes through a magnetic circuit 168 at least including the boss part 133, the flux guides 164*a*, 164*b*, and the guide gaps 166*a*, 166*b* and 166*c*. The magnetic flux passes through loops as shown in arrow symbols in FIG. 5. The magnetic circuit 168 is formed to guide the magnetic flux. The magnetic flux passes through the flux guides 164*a*, 164*b*, and 164*c*, the guide gaps 166*a*, 166*b*, and 166*c*, and the boss part 133. Then, the magnetic flux passes the boss part 133 from the inside to the outside of the case 110, and passes through from the boss part 133 to the first housing 111 via the bearing 115.

The magnetic flux is evenly distributed to the flux guides 164*a*, 164*b*, and 164*c* and the guide gaps 166*a*, 166*b*, and 166*c*. In the sealing device 160, the MRF 140 reaches to the guide gaps 166*a*, 166*b*, and 166*c*, and is trapped in the guide gaps 166*a*, 166*b*, and 166*c*. The viscosity of the MRF 140 trapped in the guide gaps 166*a*, 166*b*, and 166*c* is increased due to a concentrated magnetic flux. The magnetic flux of the magnet 162 is mainly guided to the guide gaps 166*a*, 166*b*, and 166*c*. Since the magnet 162 and the flux guides 164*a*, 164*b*, and 164*c* are supported on the case 110 which is a fixed member, it is possible to supply the magnetic flux in a stable manner and to prevent a fluctuation of the magnetic flux in the guide gaps 166*a*, 166*b*, and 166*c*. Since the magnetic flux is guided efficiently and stably to the guide gaps 166*a*, 166*b*, and 166*c*, it is possible to increase the viscosity of the MRF 140 certainly.

The MRF 140 forms sealing film on each of the guide gaps 166*a*, 166*b*, and 166*c*. The MRF 140 forms a plurality of sealing films, i.e., multi-staged sealing films, along the boss part 133. The MRF 140 demonstrates a self-sealing function by the sealing films. Since the self-sealing function is provided by the MRF 140 itself, it is possible to suppress a leaking of the MRF 140 and to lower a friction drag for rotating the rotor 130. According to the embodiment, it is possible to lower a friction drag between a stable component 110 and a rotating component 130. It is possible to reduce wear of the components 110 and 130. It is possible to suppress degradation of the bearing 115 by a leaked MRF. Further, it is possible to suppress change of an input characteristic of the braking torque caused by a leakage of the MRF. It is possible to suppress change of an adjusting characteristic of the engine phase caused by a leakage of the MRF. In addition, it is possible to reduce a torque loss when the braking torque is disappeared or controlled as less as possible. The torque loss is proportional to a product of three components. The first component is a value of square of a radius of the inside diameter of the guide gaps 166*a*, 166*b*, and 166*c*, i.e., the outside diameter of the boss part 133. The second component is a total of the axial length of the guide gaps 166*a*, 166*b*, and 166*c*, i.e., the axial thickness of the flux guides 164*a*, 164*b*, and 164*c*. The third component is a seal resistance generated on the guide gaps 166*a*, 166*b*, and 166*c*. Therefore, since the sealing device 160 can be manufactured to obtain a comparatively thin axial thickness for each of the flux guides 164*a*, 164*b*, and 164*c*, it is possible to improve a sealing performance, and also to reduce the torque loss sufficiently. Therefore, in a case of the engine having a camshaft 2 which receives a rotation loss corresponding to the torque loss of the actuator which is engaged with the phase adjusting mechanism 300, it is possible to reduce the rotation loss on the camshaft 2 and to avoid a worsening of the fuel consumption by the rotation loss.

Figure 5:
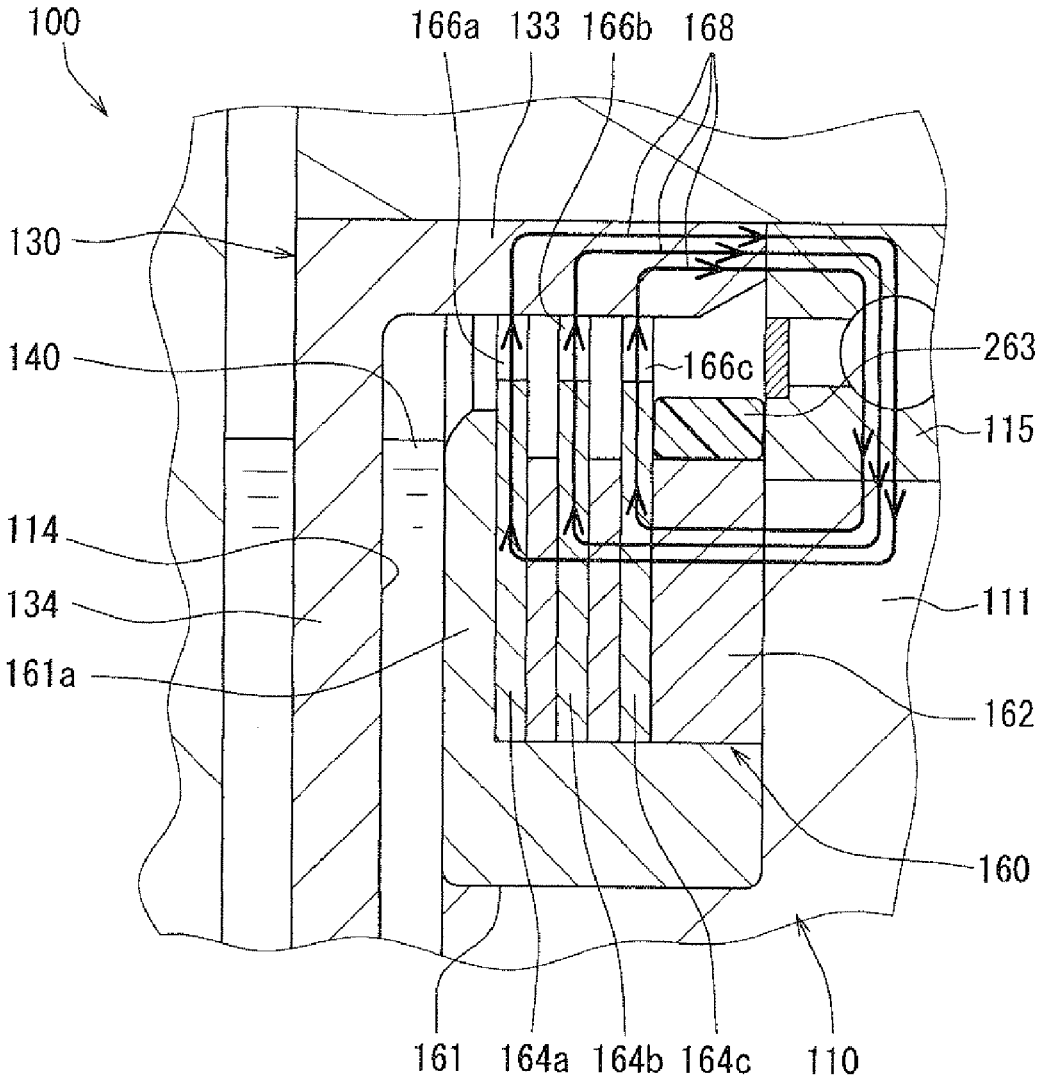
FIG. 5 is a partial enlarged sectional view showing the actuator in FIG. 1.

According to the first embodiment, it is possible to improve both durability and reliability, and to contribute to improve fuel consumption. The solenoid coil 150 and the control circuit 200 construct the viscosity control means. The first housing 111 and the bearing 115 jointly construct the magnetic yoke portion. Therefore, the case has the magnetic yoke portion for conducting the magnetic flux at a position opposite to the flux guides with respect to the magnet in the axial direction. In addition to the above mentioned configuration of the first embodiment, as shown in FIG. 5, a nonmagnetic member 263 may be disposed in an annular gap formed on a radial inside to the magnet 162 and between the flux guides 164 and the magnetic yoke portion 111 and 115. The nonmagnetic member 263 reduces a volume of the annular gap and prevents a leakage of the magnetic flux.

Second Embodiment

Figure 6:
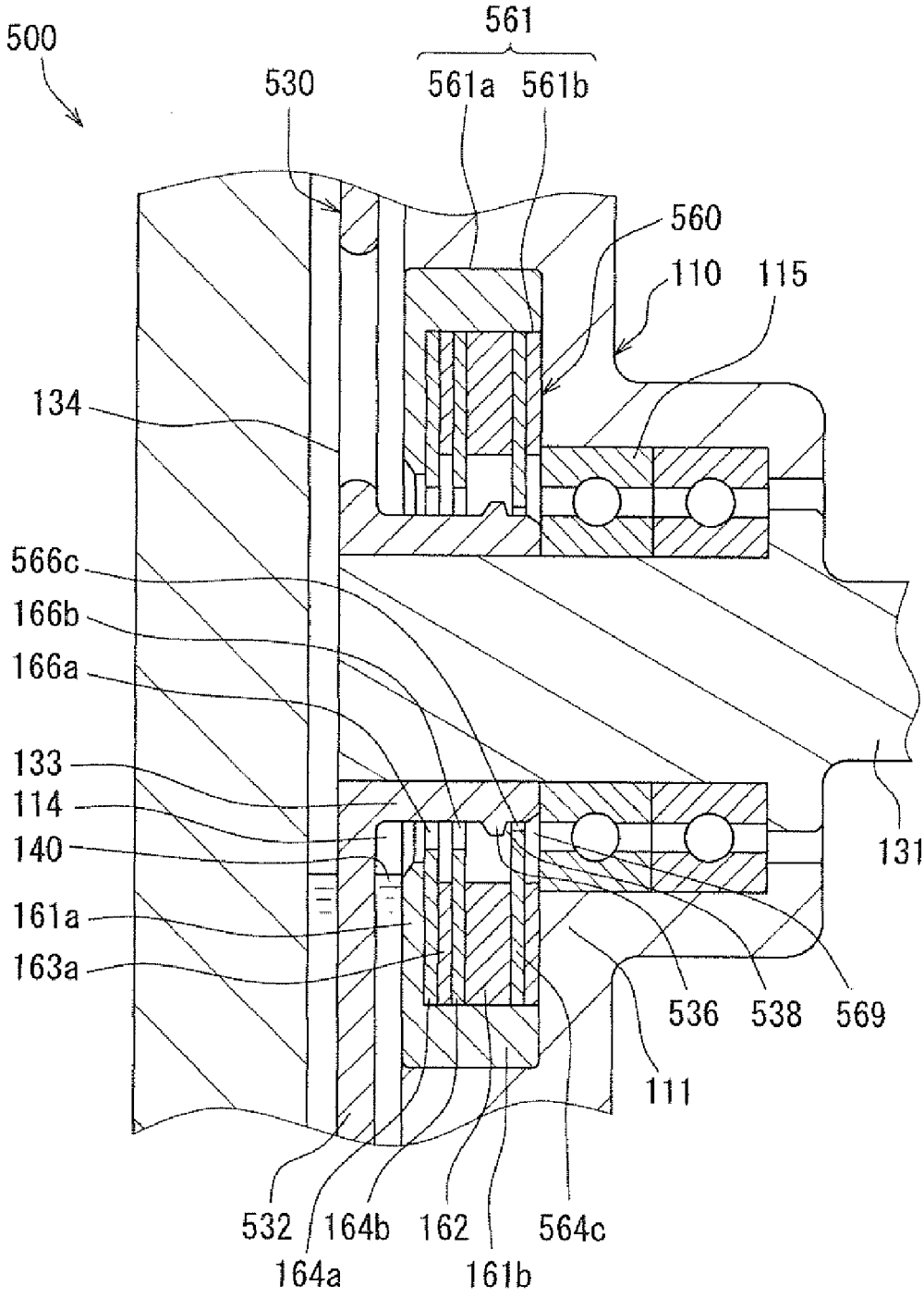
FIG. 6 is a partial enlarged sectional view showing a variable valve timing apparatus according to a second embodiment of the present invention.

As shown in FIG. 6, the second embodiment of the present invention is a modification of the first embodiment. The actuator 500 in the second embodiment is provided with a sealing device 560 and a nonmagnetic shield member 561. The components 560 and 561 are different from the first embodiment.

The nonmagnetic shield member 561 has a main part 561*a* and a cover part 561*b*. The main part 561*a* is substantially identical to the nonmagnetic shield member 161 of the first embodiment. The main part 561*a* has a cylindrical part and a bottom wall part on one end of the cylindrical part. The cover part 561*b* covers the other end of the cylindrical part. The cover part 561*b* is formed in an annular plate shape and is made of the same magnetic material as the main part 561*a*. The cover part 561*b* is placed on a radial outside to the boss part 133. The cover part 561*b* is disposed next to the bearing 115 on the inside of the case 110. The cover part 561*b* and the bottom wall portions 161*a* of the main part 561 axially clamps and supports the sealing device 560. In addition, in the sealing device 560, the magnetic spacer 163*b* and the flux guide 164*c* in the first embodiment are eliminated. Instead, the flux guide 164*b* is placed next to the magnet 162 on a side closer to the inside of the case 110. The magnetic guide 564*c* is placed next to the magnet 162 on a side closer to the outside of the case 110. The magnetic guide 564*c* is placed between the magnet 162 and the cover part 561*b*. In the sealing device 560, the flux guides 164*a*, 164*b* and 564*c* are arranged on both sides of the magnet 162 in the axial direction in a distributed manner. Therefore, the flux guides are arranged on both sides of the magnet in the axial direction. At least one of the flux guides is arranged on a position closer to the inside of the case than the magnet. At least one of the flux guides is arranged on a position closer to the outside of the case than the magnet.

The flux guide 564*c* is formed in an annular plate shape and is made of the same magnetic material as other flux guides 164*a* and 164*b*. The flux guide 564*c* has a radial inside surface which extends continuously along a circumferential direction of the rotor 130, i.e., the boss part 133. The flux guide 564*c* is securely fixed on a radial inside surface of the peripheral wall part 161*b* of the main part 561*a* of the nonmagnetic shield 561. The flux guide 564*c* is securely fixed on the case 110 through the nonmagnetic shield member 561. An axial gap 569 having an axial distance corresponding to a thickness of the shield cover 561*b* is defined between the flux guide 564*c* and the bearing 115. In other word, the flux guide 564*c* arranged on the side of the magnet 162 closer to the outside of the case 110 defines the axial gap 569 between itself and the bearing 115. The axial gap 569 may be called as a fluid catcher. The axial thickness of the flux guide 564*c* may be designed in various sizes. However, in order to facilitate manufacturing advantages, the flux guide 564*c* is formed as same as the other flux guides 164*a* and 164*b*. The flux guide 564*c* has a radial inner diameter that is smaller than a radial inner diameter of each one of the adjacent components 162 and 561*b*. The flux guides 564*c* have the radial inner diameter that is smaller than radial inner diameters of the other flux guides 164*a* and 164*b*. The flux guide 564*c* has the radial inner diameter that is larger than a radial outer diameter of the boss part 133. A radial inside surface of the flux guide 564*c* and a radial outside surface of the boss part 133 define a guide gap 566*c*. The guide gap 566*c* is placed on a position closer to the outside of the case 110 than the magnet 162. The guide gap 566*c* defines a radial distance which is smaller than that of the other guide gaps 166*a* and 166*b*. Therefore, the guide gap 566*c* which defines the smallest radial distance among the guide gaps in the sealing device 560 is placed on a position closest to the outside of the case 110. In addition, the guide gap 566*c*, i.e., the most outside guide gap, defines the radial distance that is smaller than the thickness of the bottom wall portion 161*a* in the axial direction. The bottom wall portion 161*a* is placed to be directly exposed to the fluid chamber 114 to be come in contact with the MRF 140 directly and to face to the rotor 130 in the axial direction. According to the second embodiment, the guide gaps 166*a*, 166*b*, and 566*c* which have different radial distances are arranged along a direction from the inside to the outside of the case 110. In addition, the most outside guide gap 566*c* defines the narrowest guide gap.

Figure 7:
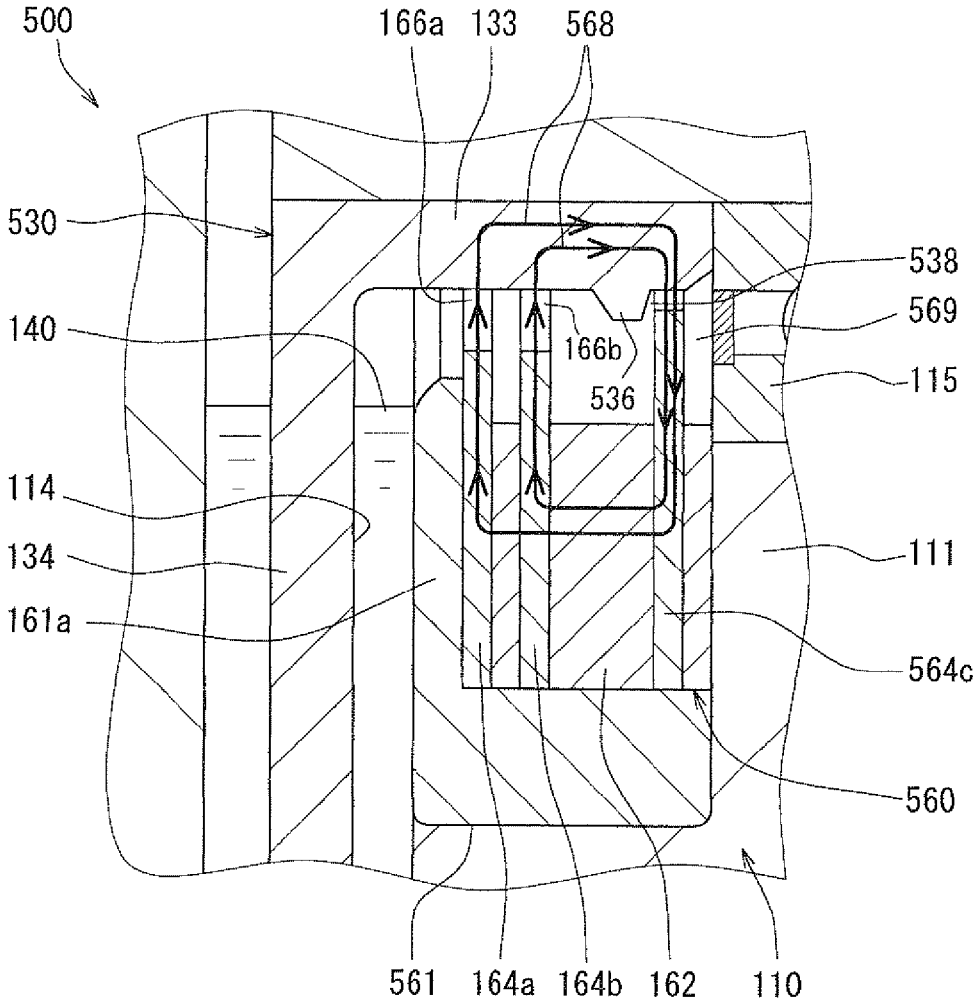
FIG. 7 is a partial enlarged sectional view showing the actuator in FIG. 6.

The magnetic rotation member 532 is further formed with a protruded portion 536. The protruded portion 536 is formed as a flange or an annular plate shape. The protruded portion 536 continuously extends along a rotational direction of the rotor 530. The protruded portion 536 is located on the boss part 133 at a position closer to the outside of the case 110 than the plate part 134. In other word, the protruded portion 536 is located on a position closer to the bearing 115 than the plate portion 134. The protruded portion 536 is located between the flux guides 164*b* and 564*c* which are located on both sides of the magnet 162 with respect to the axial direction. The protruded portion 536 radially extends into an axial gap defined between the flux guides 164*b* and 564*c* in an inserting manner. The protruded portion 536 defines at least one axial gap with one of the flux guides 164*b* and 564*c*. The protruded portion 536 and the flux guides 164*b* and 564*c* define a labyrinth-like fluid path 538 between the case 110 and the rotor 530. The path 538 is sufficiently narrow to provide a flow resistance to the MRF 140. The path 538 defines sufficiently long distance from the inside to the outside of the case 110. The path 538 defines at least one of right-angled bends to provide a flow resistance to the MRF 140. The protruded portion 536 has a radial height that is smaller than radial distances of the guide gaps 166*a* and 166*b*. The radial height of the protruded portion 536 is greater than a radial distance of the guide gap 566*c*. The radial height of the protruded portion 536 is greater than at least one of distances of the guide gaps located on both sides of the magnet. The protruded portion 536 has a radial height that is greater than a radial distance of the guide gap 566*c* defined by the flux guide 564*c* arranged on the side of the magnet 162 closer to the outside of the case 110. According to the above configuration, it is possible to form the labyrinth-like fluid passage on the fluid path 538. In addition, it is possible to manufacture the labyrinth-like fluid passage easily. The nonmagnetic shield member 561 has the bottom wall portion 161*a* that has an axial thickness thicker than the radial distances of the guide gaps 166*a*, 166*b* and 566*c*. The bottom wall portion 161*a* works as a magnetic shield. The magnetic flux of the magnet 162 is prevented from leaking to a side of the fluid chamber 114 from the bottom wall portion 161*a*. The magnetic flux passes through a magnetic circuit 568 as shown in arrow symbols in FIG. 7. The magnetic circuit 568 is formed to guide the magnetic flux. The magnetic flux passes through the flux guides 164*a*, and 164*b*, the guide gaps 166*a*, and 166*b*, and the boss part 133. Then, the magnetic flux passes the boss part 133 from the inside to the outside of the case 110, and passes through from the boss part 133 to the flux guide 564*c* via the guide gap 566*c*.

In the sealing device 560, the magnetic flux of the magnet 162 is guided to pass the guide gaps 166*a* and 166*b* defined by the flux guides 164*a* and 164*b* and the guide gap 566*c* defined by the flux guide 564*c* in a series manner. The guide gaps 166*a* and 166*b* may be called as inside guide gaps 166*a* and 166*b*. The flux guides 164*a* and 164*b* may be called as inside flux guides 164*a* and 164*b*, since those members are disposed on a side of the magnet 162 closer to the inside of the fluid chamber 114. The guide gap 566*c* may be called as an inside guide gap 566*c*. The flux guide 564*c* may be called as an inside flux guide 564*c*, since the member is disposed on a side of the magnet 162 closer to the outside of the fluid chamber 114. Since the magnet 162 and the flux guides 164*a*, 164*b*, and 564*c* are supported on the case 110 which is a fixed member, it is possible to supply the magnetic flux in a stable manner and to prevent a fluctuation of the magnetic flux in the guide gaps 166*a*, 166*b*, and 566*c*. The MRF 140 flows into the guide gaps 166*a*, 166*b*, and 566*c*, and trapped. The viscosity of the trapped MRF 140 is increased due to the concentrated magnetic flux in the guide gaps 166*a*, 166*b*, and 566*c*. The MRF 140 forms a plurality of sealing films, i.e., multi-staged sealing films, along the boss part 133. The MRF 140 demonstrates a self-sealing function by the sealing films. Since the self-sealing function is provided by the MRF 140 itself, it is possible to suppress a leaking of the MRF 140 and to lower a friction drag for rotating the rotor 130.

In the sealing device 560, a first distance of the guide gap 566*c* located at a position closer to the outside of the case 110 than the magnet 162 is different from a second distance of the guide gaps 166*a* and 166*b* located at a position closer to the inside of the case 110 than the magnet 162. In other word, the guide gap 566*c* arranged on the portion closer to the outside of the case 110 than the magnet 162 defines the first distance. The guide gaps 166*a* and 166*b* arranged on the portion closer to the inside of the case 110 than the magnet 162 define the second distances respectively. The first distance is smaller than the second distances. Even if the MRF 140 breaks through the guide gaps 166*a* and 166*b*, it is still possible to trap the MRF 140 in the guide gap 566*c* which is the narrowest. In the sealing device 560, an axial distance between the guide gaps 166*b* and the 566*c* is apparently longer than an axial distance between the guide gaps 166*a* and 166*b*. The longer axial distance corresponds to the axial thickness of the magnet 162. The sealing device 560 has a labyrinth passage in a portion defining the longer axial distance. The labyrinth passage is defined by the protruded portion 536 inserted between the guide gap 166*b* and the guide gap 566*c*. Therefore, the sealing device 560 has both a magnetic fluidic seal part and a labyrinth fluidic seal part. Even if the MRF 140 beaks through the guide gaps 166*a* and 166*b*, the MRF 140 is stopped by a high flow resistance provided by the labyrinth passage and kept there. In addition, the sealing device 560 has the axial gap 569 between the flux guide 564*c* and the bearing 115. Therefore, even if the MRF 140 breaks through the magnetic fluidic seal part and the labyrinth fluidic seal part, the axial gap 569 still catches the MRF 140 to prevent from leaking. As a result, it is possible to improve sealing performance for the MRF 140.

According to the second embodiment, it is possible to reduce wearing caused by a friction between the elements 110 and 530. In addition, it is possible to avoid degradation of the bearing 115 caused by a leakage of the MRF 140. Further, it is possible to avoid characteristic change caused by a leakage of the MRF 140. Therefore, it is possible to improve both durability and reliability.

Third Embodiment

Figure 8:
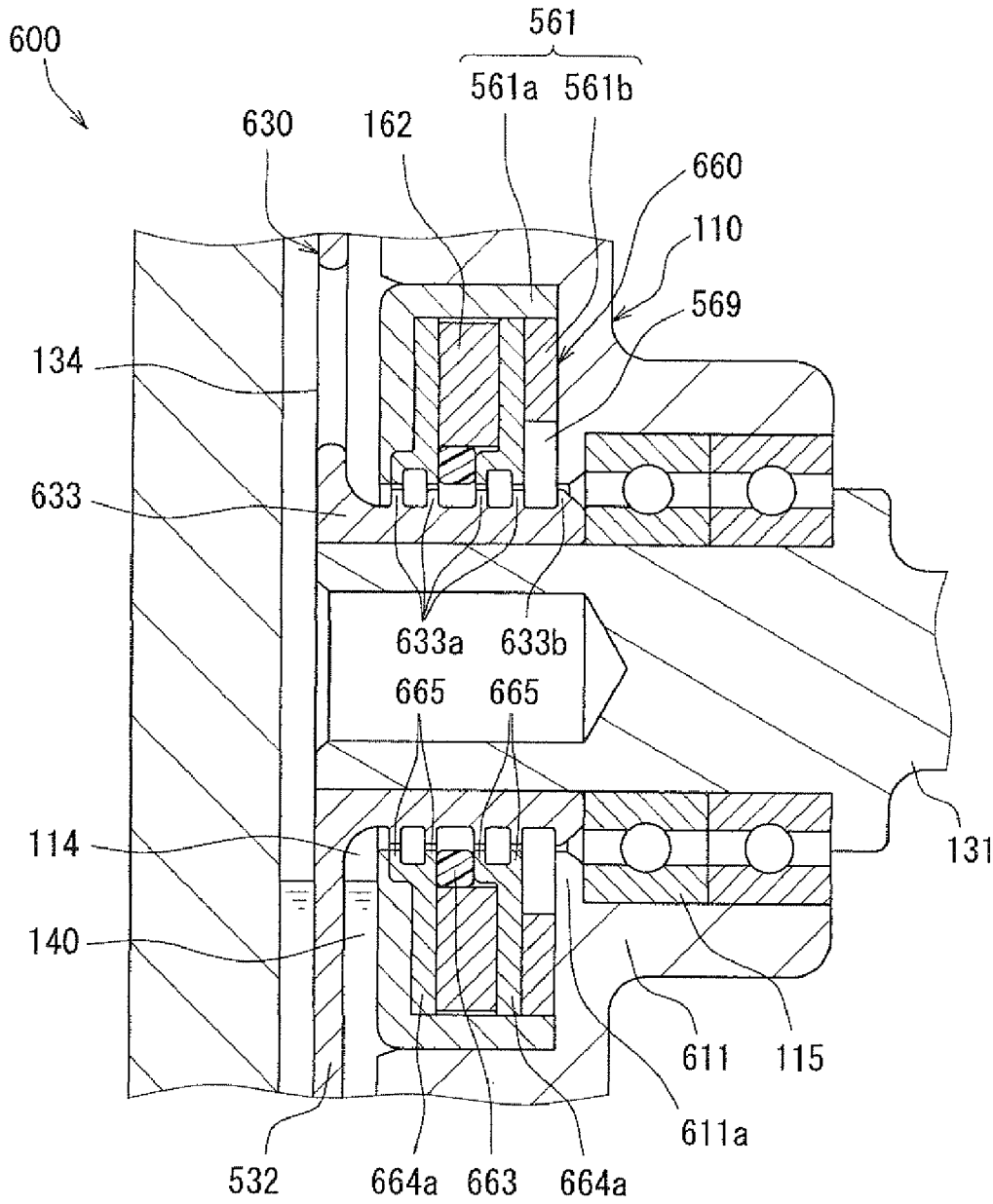
FIG. 8 is a partial enlarged sectional view showing a variable valve timing apparatus according to a third embodiment of the present invention.
Figure 9:
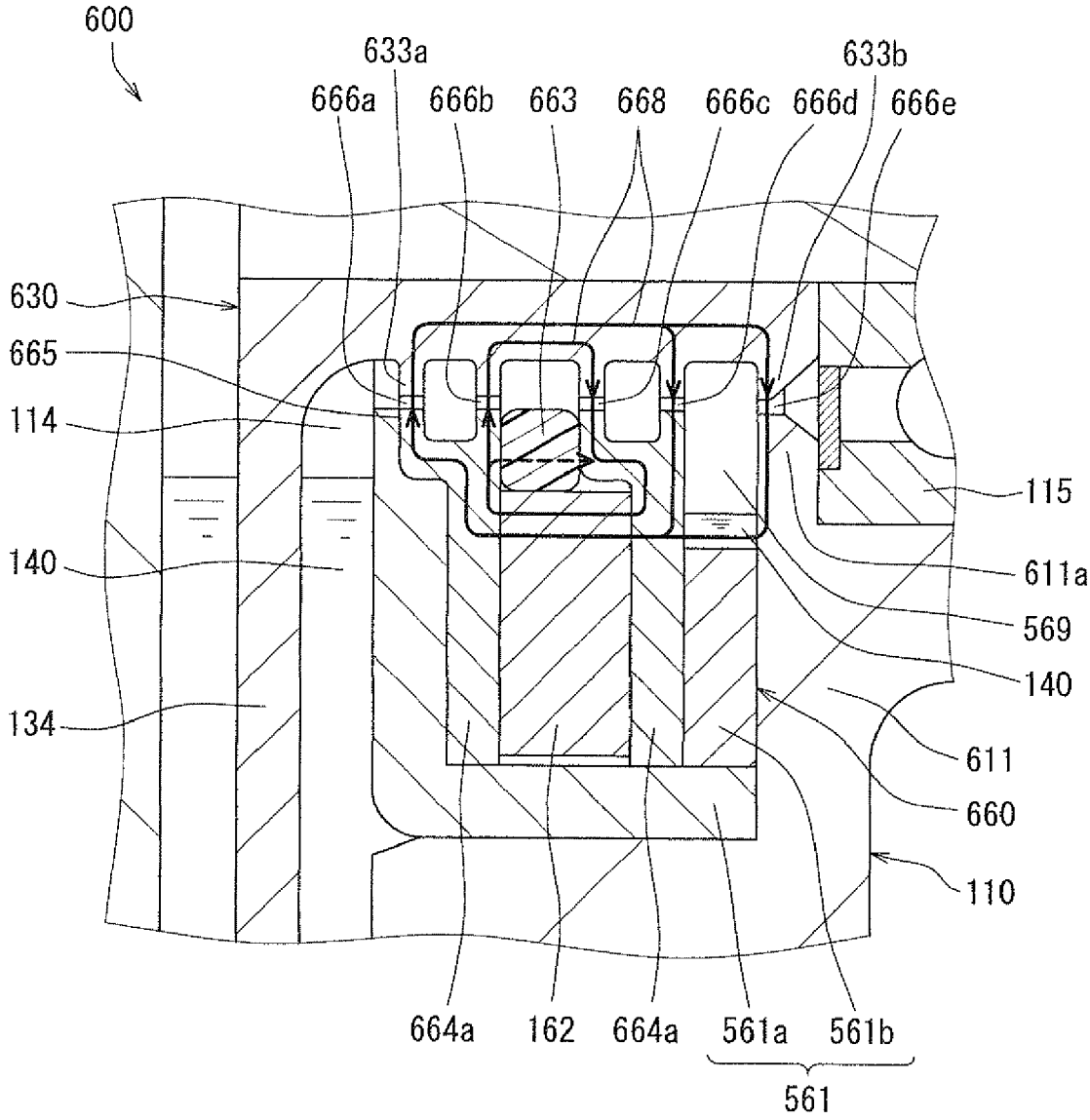
FIG. 9 is a partial enlarged sectional view showing the actuator in FIG. 8.

FIG. 8 shows an actuator 600 for the variable valve timing apparatus 1 according to the third embodiment. FIG. 8 is an enlarged sectional view showing a similar portion shown in FIGS. 4 and 6. FIG. 9 is a schematic diagram for explaining the actuator 600 in FIG. 8. As shown in FIG. 8, the embodiment is a modification of the second embodiment. The actuator 600 in the embodiment is provided with a sealing device 660, a rotor 630 and a case 110. The components 660, 630 and 110 are different from the second embodiment. The sealing device 660 has the magnet 162 which is the same as in the second embodiment, and the nonmagnetic shield member 561 which is substantially the same as the second embodiment. The sealing device 660 further has flux guides 664*a* and 664*a* which are different from the preceding embodiment. One flux guide 664*a* is arranged on one side of the magnet 162. The other one flux guide 664*a* is arranged on the other side of the magnet 162. In other word, the flux guides 664*a* and 664*a* are arranged on both sides of the magnet 162 respectively. The flux guides 664*a* collectively form a flux guide portion. The flux guide portion and the boss part 633 define a guide gap which has uneven radial distance along a direction from an inside to an outside of the case. This uneven distance provides a plurality of narrow guide gaps 666*a*, 666*b*, 666*c*, and 666*d*. The guide gaps are formed as portions defining relatively narrow distances. The guide gaps are formed by varying distance between the flux guides 664*a* and the boss part 633 along the axial direction. In the embodiment of FIG. 9, two narrow guide gaps are formed on each flux guide 664*a*. Hereinafter, those narrow guide gaps may be collectively called as a plurality of guide gaps. To provide the above-mentioned structure, the flux guide 664*a* and the boss part 633 are formed as shown in FIG. 9. The flux guide 664*a* has a radial inside portion which is branched into a plurality of guide projections 665 projecting toward the boss part. The flux guide 664*a* has a two guide projections 665. The guide projection 665 is formed in an annular disc shape which surrounds a radial outside surface of the boss part 633 along a circumferential direction. The sealing device 660 contains two flux guides 664*a* of identical shape. The flux guides on both sides of the magnet 162 may have different shapes respectively. For example, only one of the flux guides on one side of the magnet 162 may have branched guide projections, and the other one of the flux guides on the other side of the magnet 162 may have a single projection. The flux guide with branched guide projections may be used in the first embodiment. For example, at least one of the flux guides in the first embodiment may be a flux guide with branched guide projections. The boss part 633 is formed to provide a plurality of boss projections 633*a*. The boss projections 633*a* are projected toward the flux guide 664*a*. Each one of the boss projections 633*a* is formed and arranged to oppose to one of the guide projections 665. The guide projections 665 and the boss projections 633*a* define narrow parts of the guide gap therebetween. The boss projections 633*a* is formed in an annular disc shape continuously surrounding the boss part 633.

In a broad definition, the guide gap is a portion defined between a radial end surface of one flux guide and the boss part 633. In this embodiment, the radial end of the flux guide 664*a* is branched into two tops and provides two guide projections 665. Similarly, the boss part 633 has two annular flange shaped boss projections 633*a* corresponding to the guide projections 665. Therefore, one guide gap defines uneven radial distance which is varied along a direction from an inside to an outside of the case. The guide gap at least has three parts, a narrow part, a wide part and a narrow part formed in this order. The guide gap may be called as a grooved guide gap which has the wide part between the narrow parts. The narrow parts of the guide gap are defined between tops of the boss projections 633 and tops of the guide projections 665. The flux guide 664*a* defines a guide groove between the guide projections 665. The boss part 633 also defines a boss groove between the boss projections 633*a*. The wide part of the guide gap is defined between the guide groove and the boss groove. In this embodiment, both components, the flux guide and the boss part, are formed in branched shapes in order to form a plurality of guide gaps 666*a*, 666*b*, 666*c*, and 666*d*. For this purpose, a plurality of guide projections 665 and a plurality of boss projections 633*a* are formed. Alternatively, only the flux guide 664*a* may be formed in a branched shape. A combination of a plurality of guide projections 665 and a simple cylindrical shaped boss part can form a plurality of guide gaps. Further, only the boss part 633 may be formed in a branched shape. A combination of a plurality of boss projections 633*a* and a simple cylindrical shaped flux guide can form a plurality of guide gaps.

According to the embodiment and above-mentioned modifications, a plurality of guide gaps including narrow parts and a wide part are formed between one flux guide and one boss part. According to the embodiment and above-mentioned modifications, the MRF 140 is trapped at the narrow parts and forms films to perform self sealing parts. The wide part is placed between the narrow parts. In other word, at least one wide part is placed next to the narrow part on a side closer to the outside of the case 110 than the narrow part. Further, the wide part is defined by at least one depression. The wide part is depressed from the narrow part in both radial directions, in a radial inside direction, or in a radial outside direction. The wide part effectively traps the MRF 140. Therefore, even if the MRF 140 breaks through the narrow part, the wide part placed on a downstream side traps the MRF 140 and spoils flow of the MRF 140. As a result, the next narrow part placed on a downstream side of the wide part can traps the MRF 140 and effectively maintains the self sealing performance. The MRF 140 can be trapped and expanded by single depression, i.e., a groove, formed on the flux guide 664*a* or the boss part 633. The depressions on both sides formed on both the flux guide 664*a* and the boss part 633 can effectively trap and effectively expand the MRF 140. The case 110 includes a first housing 611 and a second housing 112 which is similar to the preceding embodiments. The first housing 611 is formed to provide a contact part 611*a* which is located to come in contact with the bearing 115 in an axial direction. The contact part 611*a* is formed between the bearing 115 and the sealing device 660 in the axial direction. The contact part 611*a* is formed in an annular disc shape completely surrounding the boss part 633. The contact part 611*a* is located as a part of a positioning member for the bearing 115 with respect to the axial direction. The contact part 611*a* has an inner surface which is placed to oppose to an outer surface of the boss part 633. As a result, another guide gap 666*e* is defined between the inner surface of the contact part 611*a* and the outer surface of the boss part 633. For this purpose, the boss part 633 has a boss projection 633*b* which is located to oppose to the contact part 611*a*. The boss projection 633*b* is formed in an annular disc shape continuously surrounding the outer surface of the boss part 633. The guide gaps 666*a*, 666*b*, 666*c*, and 666*d* with identical radial distance and the guide gap 666*e* are arranged from the inside to the outside of the case 110. The guide gap 666*e* is arranged between the sealing device 660 and the bearing 115. In other word, the guide gap 666*e* is placed on a position closer to the outside of the case 110 than the sealing device 660.

A nonmagnetic member is disposed in an annular gap formed on a radial inside to the magnet 162 and between the flux guides 664*a* separately disposed on both sides of the magnet 162. The nonmagnetic member is a nonmagnetic ring 663. If the MRF 140 is introduced in an axial gap between the magnetic guides 664*a* on both sides of the magnet 162*a*, a short-cut circuit shown by a broken line in FIG. 9 may be formed in the magnetic circuit 668. This short-cut circuit reduces an amount of effective magnetic flux for the magnetic sealing. The nonmagnetic member may reduce the amount of MRF 140 in the annular axial gap. Therefore, it is possible to reduce leakage of the magnetic flux. Resin material and a non-magnetic metal can be used as the nonmagnetic member. As the non-magnetic metal, for example, the austenite type stainless steel, copper, aluminum, brass, etc. can be used. The nonmagnetic ring 663 is made of a heat-resistant fluoro-resin. The nonmagnetic ring 663 is assembled as a component of the sealing device 660. In an assembling process, the nonmagnetic ring 663 is inserted in the magnet 162 before assembling the magnet 162 between the flux guides 664*a*. It is preferable to form and dispose the nonmagnetic member to fill up the annular gap. In this illustrated embodiment, the nonmagnetic ring 663 is disposed on the inside to the magnet 162. However, the nonmagnetic ring may be disposed on an outside to the magnet 162. The nonmagnetic ring may be disposed on any gap which may form a part of a short-cut circuit of the magnetic flux.

The magnetic flux passes through a magnetic circuit 668 as shown in arrow symbols in FIG. 9. The magnetic circuit 668 is formed to guide the magnetic flux. The magnetic flux flows from the flux guide 664*a* placed on a side close to the fluid chamber 114 to the boss part 633 in a radial outward direction through the guide projections 665, the guide gaps 666*a* and 666*b*, and the boss projections 633*a*. Then, the magnetic flux flows in the boss part 633 in an axial direction from the inside to the outside of the case. The magnetic flux flows from the boss part 633 to the flux guide 664*a* placed on a side close to the bearing 115 in a radial inward direction through the boss projections 633*a*, the guide gaps 666*c* and 666*d*, and the guide projections 665. A part of the magnetic flux passes through the boss part 633 in the axial direction is guided to the boss projection 633*b*. The magnetic flux flows to the contact part 611*a* through the guide gap 666*e*. Then, the magnetic flux flows to the flux guide 664*a* placed on the side close to the bearing 115 through the MRF 140 trapped in the axial gap 569. Therefore, the boss projection 633*e* and the contact part 611*a* provide an additional path which is formed by the MRF 140 trapped in the axial gap 569, i.e., a groove. The nonmagnetic shield member 561 defines the axial gap 569 and makes the magnetic flux to flow through the MRF 140 in the axial gap 569.

In this embodiment, a plurality of guide gaps 666 are formed between one flux guide 664 and the boss part 633. The guide gaps 666 are arranged in the axial direction in a multi stage fashion. According to the embodiment, it is possible to provide more guide gaps with a simple and less components structure. Here, the guide gaps are the narrow parts where the radial distance is formed narrower than the other parts on one flux guide. It is possible to provide a plurality of guide gaps by using a single flux guide. It is possible to improve the self-sealing performance by the MRF 140. In addition, since it is possible to reduce the number of flux guides to provide a certain number of guide gaps compare to a configuration where each one of flux guides provides one guide gap, it is possible to make the sealing device small. In addition, it is possible to reduce the number of components and to reduce assembling work, therefore, it is possible to reduce the cost of the variable valve timing apparatus 1. The flux guides 664*a* have a radial inside portion which is branched into a plurality of guide projections 665 projecting toward the boss part 633. The boss part 633 has a radial outside surface where a plurality of boss projections 633*a* projecting toward the flux guide 664*a* are formed corresponding to the guide projections 665. The boss projections 633*a* are formed in a branching manner. The guide gaps 666*a*, 666*b*, 666*c*, and 666*d* which are formed as the narrow parts are defined between opposing pair of the guide projection 665 and the boss projection 633*a*.

According to the above-mentioned structure, a plurality of narrow parts and a wide part are formed between the flux guide and the boss part. The guide gaps 666*a*, 666*b*, 666*c*, and 666*d* for the narrow parts trap the MRF 140 and provide self-sealing portions. At least one wide part is formed on a downstream side to one of the guide gaps 666*a*, 666*b*, 666*c* and 666*d* in a direction from the inside to the outside of the case 110. The wide parts are widened in both a radial outside direction and a radial inside direction with respect to one of the guide gaps 666*a*, 666*b*, 666*c* and 666*d* located on an upstream side thereof. The wide parts spoil flow energy of the MRF 140, even if the MRF 140 breaks through the upstream side one of the guide gaps 666*a*, 666*b*, and 666*c*. As a result, the downstream side one of the guide gaps 666*b*, 666*c* and 666*d* may withstand against the spoiled flow of the MRF 140. The sealing device 660 is configured with at least two of flux guides 664*a* of identical shapes among a plurality of flux guides 664. It is possible to reduce number of components, and to reduce the cost of the variable valve timing apparatus 1. The contact part 611*a* is formed between the bearing 115 and the sealing device 660 in the axial direction. The contact part 611*a* has a radial inside surface which is placed to face a radial outside surface of the boss part 633. The guide gap 666*e* is defined between the radial inside surface of the contact part 611*a* and the radial outside surface of the boss part 633.

According to the embodiment, an additional self-sealing portion is formed between the contact part 611*a* and the boss part 633. The additional self-sealing portion is located on a side close to the inside of the case with respect to the bearing. In other word, the additional self-sealing portion is placed between a stack of the flux guides 664 and the bearing 115. This additional self-sealing portion allows to utilize the magnetic flux which is guided to pass through the bearing 115 in the first embodiment. In addition, since the number of self-sealing stages is increased compared to the second embodiment, therefore, it is possible to improve sealing performance. In addition, the nonmagnetic ring 663 is arranged in the annular gap which is formed on the radial inside of the magnet 162 and is formed between the flux guides 664*a* on both sides of the magnet 162. According to this structure, the nonmagnetic ring 663 prevents the MRF 140 from being trapped in the annular gap. Therefore, it is possible to prevent a short cut circuit of the magnetic flux formed by the MRF 140 trapped in the annular gap. It is possible to supply the magnetic flux to the guide gaps in a stable manner. According to the third embodiment, it is possible to reduce wearing caused by a friction between the elements 110 and 630. In addition, it is possible to avoid degradation of the bearing 115 caused by a leakage of the MRF 140. Further, it is possible to avoid characteristic change caused by a leakage of the MRF 140. Therefore, it is possible to improve both durability and reliability.

Fourth Embodiment

Figure 10:
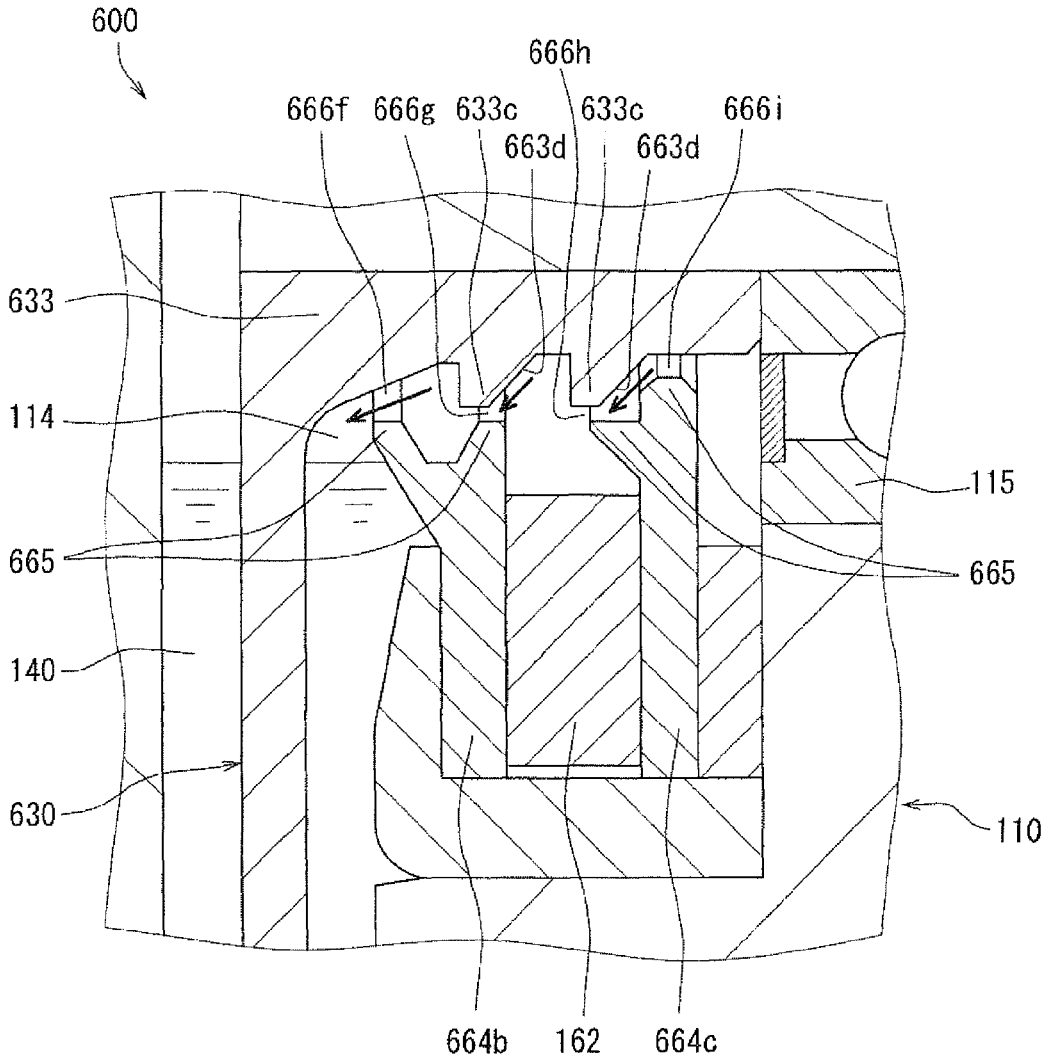
FIG. 10 is a partial enlarged sectional view showing a variable valve timing apparatus according to a fourth embodiment of the present invention.

FIG. 10 shows an actuator 600 for the variable valve timing apparatus 1 according to the fourth embodiment. FIG. 10 is an expanded sectional view showing a similar portion shown in FIG. 9. The fourth embodiment is different from the third embodiment in the following points. The rotor 630 has a boss part 633. The boss part 633 has an outer surface where annular shaped boss projections 633*c* are formed. The boss projections 633*c* oppose to the flux guides 664*b* and 664*c* in radial directions. Each of the boss projections 633*c* has an outer surface which faces an inner surface of one of the flux guides 664*b* and 664*c*. Each of the boss projections 633*c* is formed in an annular disc shape continuously surrounding the outer surface of the boss part 633. The flux guides 664*b* and 664*c* are arranged on respective sides of the magnet 162, and have different shapes. Both the flux guides 664*b* and 664*c* have two projections 665 respectively. Therefore, the flux guides 664*b* and 664*c* and the boss part 633 define a plurality of guide gaps 666*f*, 666*g*, 666*h*, and 666*i*.

Each of the boss projections 663*c* has an inclined surface on a side close to the phase adjusting mechanism 300. In other word, the boss projection 663*c* has the inclined surface on a side close to the bearing 115. In detail, the boss projection 663*c* has a cylindrical outer surface and both side surfaces located on both sides of the cylindrical outer surface. One of the side surfaces is the inclined surface which gradually increases a diameter of the boss part 663 from a side close to the bearing to a side close to the rotor 630. The inclined surface at least partially faces the radial inner surface of the flux guides 664*b* and 664*c* in a radial direction. As a result, an inclined guide gap is formed on the inclined surface. The inclined guide gap has gradually increasing diameter along a direction from an outside to an inside of the case. The other one of the side surface is formed in a radial surface spreading in almost perpendicularly. The inclined surface may be formed on a part of the side of the boss projection 633*c* in a circumferential direction. The inclined surface may be formed as a tapered surface 663*d* which is formed on an entire circumference of the side of the boss projections 633*c*. The MRF 140 trapped on the guide gaps 666*f*, 666*g*, 666*h*, and 666*i* are drawn toward the inside of the case 110 due to a pressure drop in the case 110. The tapered surface 663*d* formed as the inclined surface on the boss projection 633*c* guides the MRF in a direction from the outside to the inside of the case 110. The MRF may flow as shown in arrow symbols in FIG. 10. Therefore, the inclined surface facilitates a returning flow of the MRF to the fluid chamber 114. In addition, The MRF trapped in the guide gaps 666*f*, 666*g*, 666*h*, and 666*i* is sucked and drawn in a direction from an outside to an inside of the case, when a pressure in the case 110 is dropped as temperature decreases.

According to the fourth embodiment, it is possible to reduce wearing caused by a friction between the elements 110 and 630. In addition, it is possible to avoid degradation of the bearing 115 caused by a leakage of the MRF 140. Further, it is possible to avoid characteristic change caused by a leakage of the MRF 140. Therefore, it is possible to improve both durability and reliability.

Fifth Embodiment

Figure 11:
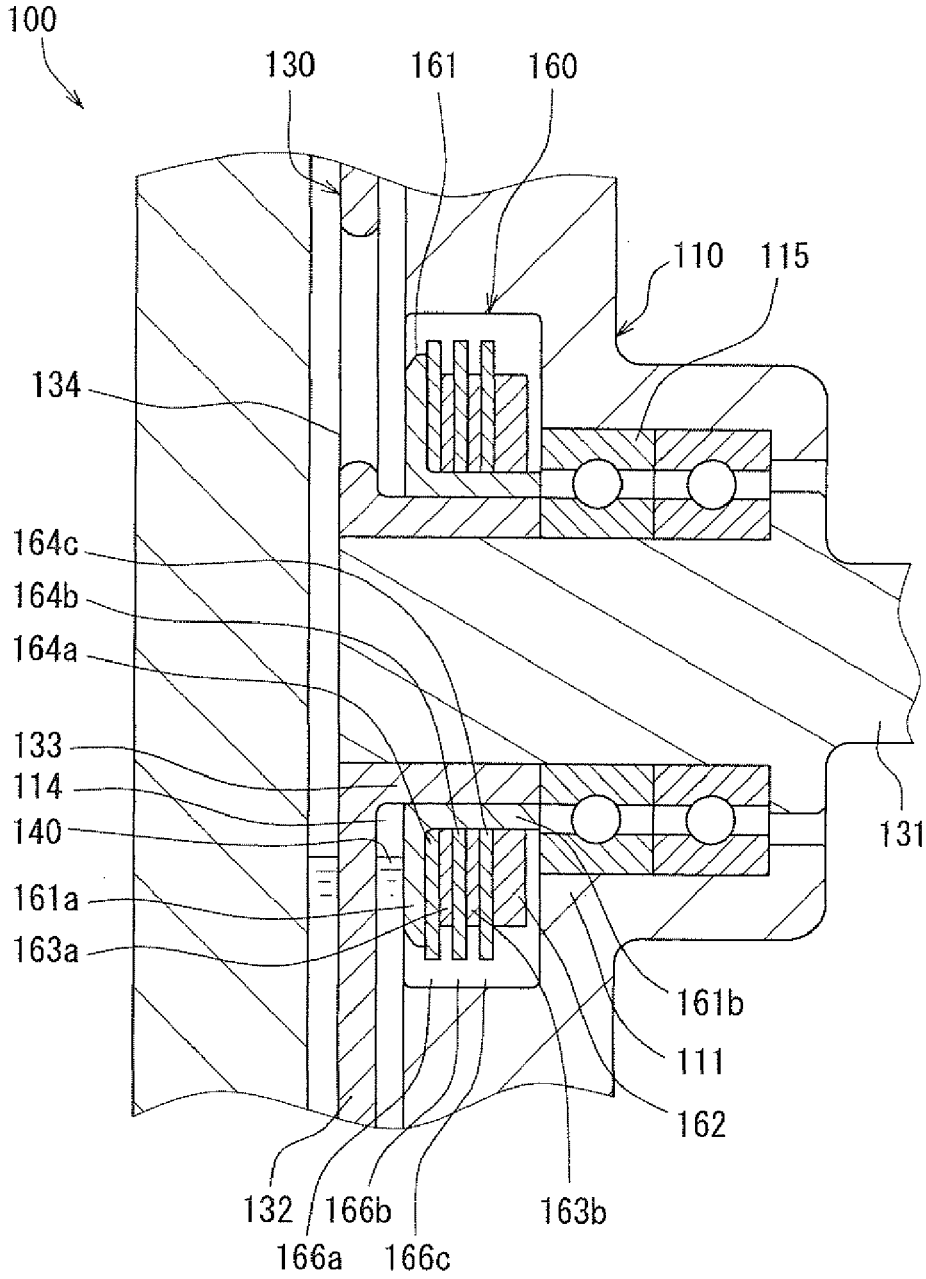
FIG. 11 is a partial enlarged sectional view showing a variable valve timing apparatus according to a fifth embodiment of the present invention.

FIG. 11 is a partially enlarged sectional view of the fifth embodiment which is a modification of the first embodiment. FIG. 11 shows the cross section corresponding to FIG. 4. As shown in FIG. 11, the magnet 162 and the flux guides 164*a*, 164*b*, 164*c*, and 564*c* are supported on the rotor 130, i.e., the boss part 133, via a nonmagnetic shield member 161. Alternatively, the components for the sealing device may be supported on the rotor 530 in other embodiment. A plurality of guide gaps 166*a*, 166*b*, 166*c*, and 566*c* may be defined between the flux guides supported on the rotating member, such as the rotor 130 and the first housing 111.

Sixth Embodiment

Figure 12:
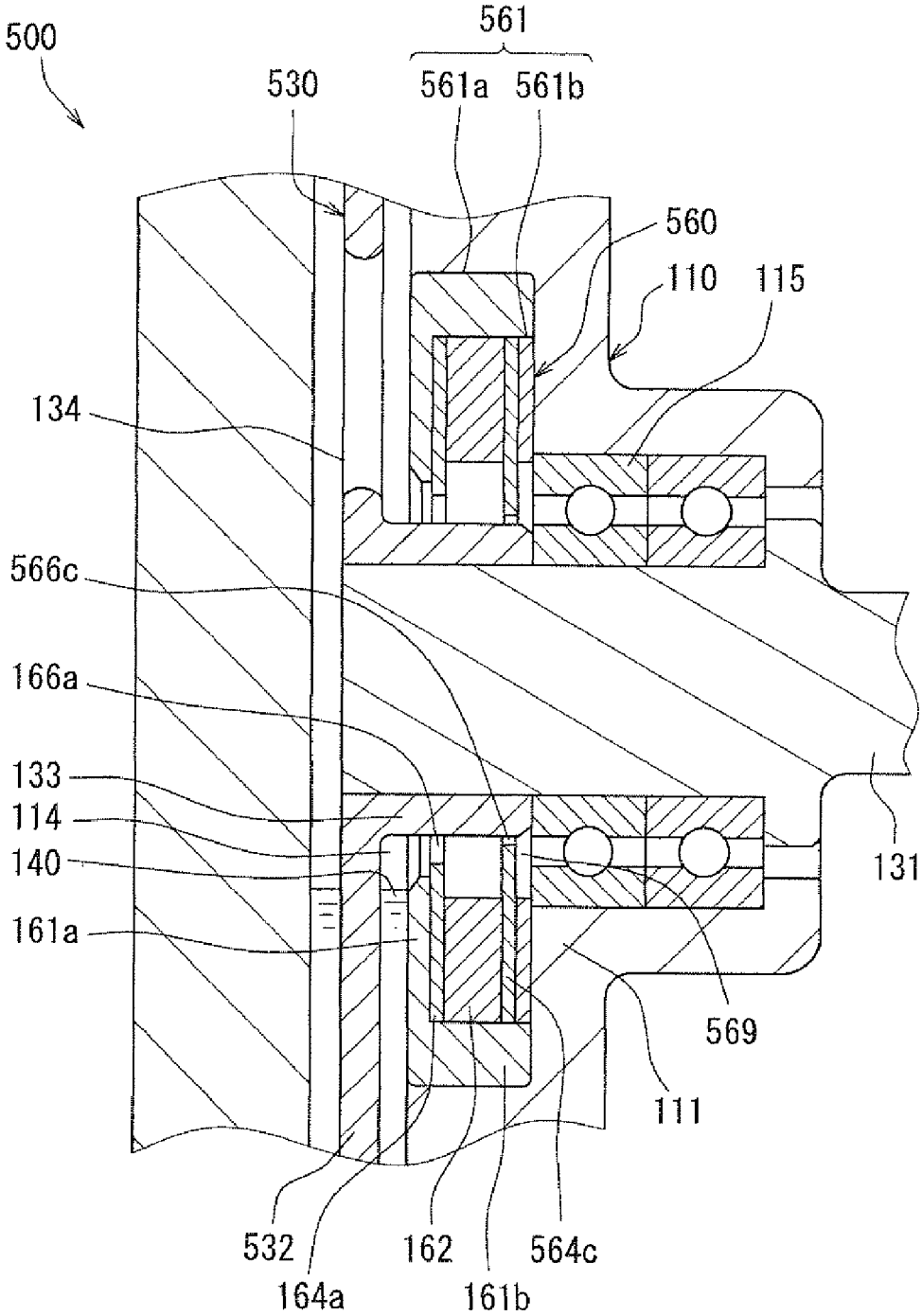
FIG. 12 is a partial enlarged sectional view showing a variable valve timing apparatus according to a sixth embodiment of the present invention.

FIG. 12 is a partially enlarged sectional view of the sixth embodiment which is a modification of the second embodiment. FIG. 12 shows the cross section corresponding to FIG. 6. The sealing device 560 in this embodiment defines guide gaps which have identical radial distance on both sides of the magnet 162. The sealing device 560 has at least one flux guide on one side of the magnet 162 and at least one flux guide on the other side of the magnet. In this embodiment, since single flux guide is placed on both sides of the magnet respectively, it is possible to make the sealing device small. Further, the protruded portion 536 in the second embodiment may be removed as shown in FIG. 12.

Seventh Embodiment

Figure 13:
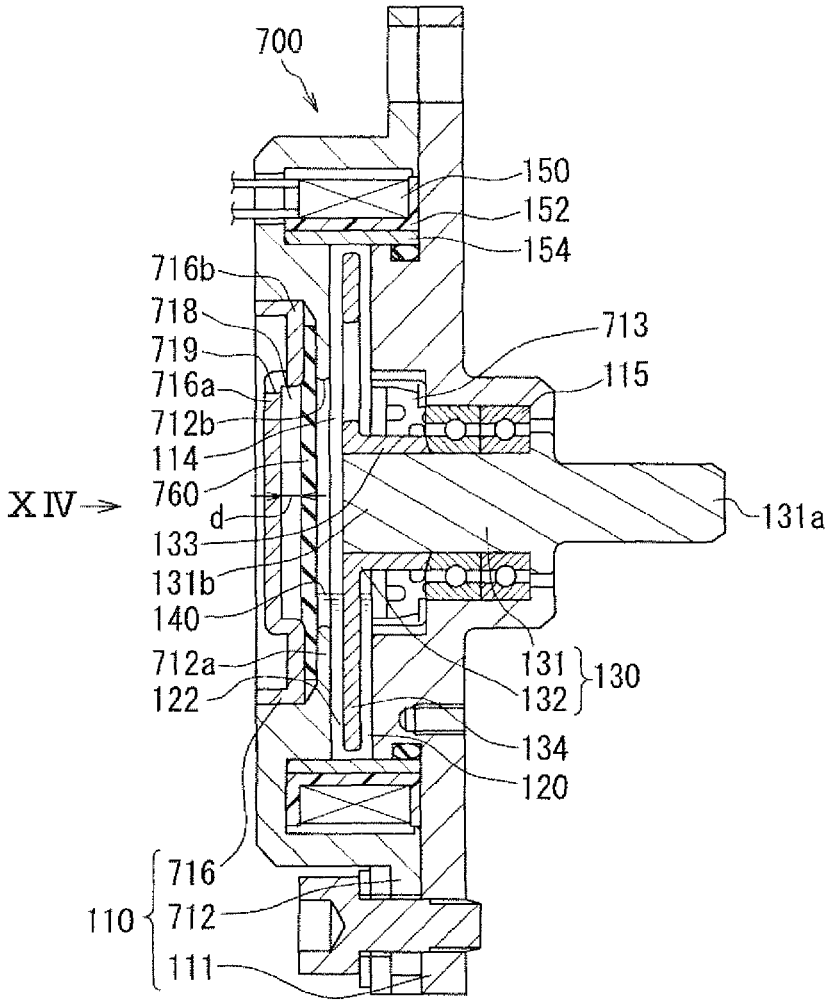
FIG. 13 is a partial enlarged sectional view showing an actuator for a variable valve timing apparatus according to a seventh embodiment of the present invention.

FIG. 13 is a sectional view showing an actuator according to a seventh embodiment of the present invention. The same or equivalent components which are already described in the preceding embodiments are denoted with the same reference numbers. The preceding descriptions may be referred for the portions denoted by the same reference numbers. In addition, some of the same or corresponding components or parts already described in the preceding embodiments are indicated by reference numbers which has its embodiment number on the hundreds and thousands places. An actuator 700 is replaceable with the actuator 100 explained in the preceding embodiments, and is engaged with the phase adjusting mechanism 300. The actuator 700 has the sealing device 713. The sealing device 713 is the oil seal made of rubber fixed to the first housing 111. The sealing device 713 is arranged between the boss part 133 as a shaft, and the case 110. The sealing device 713 provides a fluidic seal between the case 110 and the boss parts 133. The case 110 is formed by a first housing 111 and a second housing 712. The second housing 712 provides a bottom wall 712*a* on a radial central region. The bottom wall 712*a* is placed slightly depressed from an axial top plane of the second housing 712. The bottom wall 712*a* defines an exposing window 712*b* on a radial central region. The actuator 700 is provided with a diaphragm 760 which is exposed to the inside of the fluid chamber 114 defined in the case 110. The diaphragm 760 provides a movable member which enables change of the capacity of the fluid chamber 114. The diaphragm 760 suppresses an internal pressure change. The diaphragm 760 acts as a damper mechanism for absorbing an internal pressure change in the fluid chamber 114.

The diaphragm 760 is formed in a circular film shape and is made of elastically deformable material. The diaphragm 760 is coaxially arranged on the case 110. The diaphragm 760 is attached on an outside surface of the bottom wall 712*a* of the second housing 712. The diaphragm 760 is placed on a side of the bottom wall 712*a* opposite to the first housing 111. An outer periphery of the diaphragm 760 is supported on an annular part of the bottom wall 712*a* surrounding the exposing window 712*b*. The diaphragm 760 is disposed on the second housing 712 in a manner that the fluid chamber 114 provides an isolated chamber from the outside of the case 110. Therefore, the fluid chamber 114 is defined by the first housing 111, the second housing 712 and the diaphragm 760. The diaphragm 760 may be considered as a component of the case 110. The diaphragm 760 is made of material which can withstand against the MRF 140. For example, the diaphragm 760 may be made of an elastic membrane which is made of a base fabric and a vapor-deposited rubber thereon. In addition, the thickness of the diaphragm 760 can be suitably set up according to an elastic deformation characteristic which is demanded. For example, the diaphragm 760 may have a thickness within a range from about 0.5 mm to about 1.5 mm. In the actuator 700, the open chamber defining member 716 is provided as a component of the case 110. The open chamber defining member 716 may be considered as an additional component to the case 110. The open chamber defining member 716 is a cover 716 which covers an opening formed on the second housing 712. The open chamber defining member 716 may be called as the cover 716.

Figure 14:
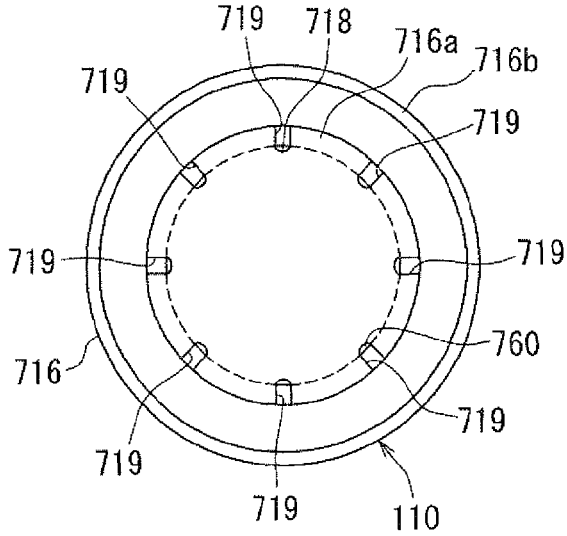
FIG. 14 is a plan view in the arrow XIV in FIG. 1.

FIG. 14 is a plan view of the cover 716. The cover 716 is formed in a dish like short cylindrical shape with a bottom wall and is made of metal. The cover 716 is coaxially fixed on the second housing 712. The cover 716 is placed on a side of the diaphragm 760 opposite to the bottom wall 712*a* of the second housing 712. In other word, the diaphragm 760 is placed and securely supported between the cover 716 and the bottom wall 712*a* of the second housing 712. The cover 716 has a bottom wall 716*a* and a flange 716*b*. The flange 716*b* is formed to extend outwardly from the bottom wall 716*a*. The flange 716*b* is securely fixed on a peripheral part of the bottom wall 712*a* of the second housing 712. The cover 716 provides an outer wall of an open chamber 718 which is defined between the cover 716 and the diaphragm 760. In addition, a plurality of air holes 719 are formed on the bottom wall 716*a* along an outer periphery in equal intervals. The air holes 719 penetrate the bottom wall 716*a*. The air holes 719 open to the outside of the case 110 and allow air flow to and from the open chamber 718. An open chamber 718 is defined between the cover 716 and the diaphragm 760. The open chamber 718 and the fluid chamber 114 are completely partitioned and divided by the diaphragm 760. The open chamber 718 is isolated from the fluid chamber 114, and is communicated with atmospheric air. The open chamber 718 is located on an opposite side of the diaphragm 760 with respect to the fluid chamber 114. The diaphragm 760 deforms and moves according to the pressure difference between the internal pressure of the open chamber 718 substantially maintained at the atmospheric pressure and the internal pressure of the fluid chamber 114.

Figure 15:
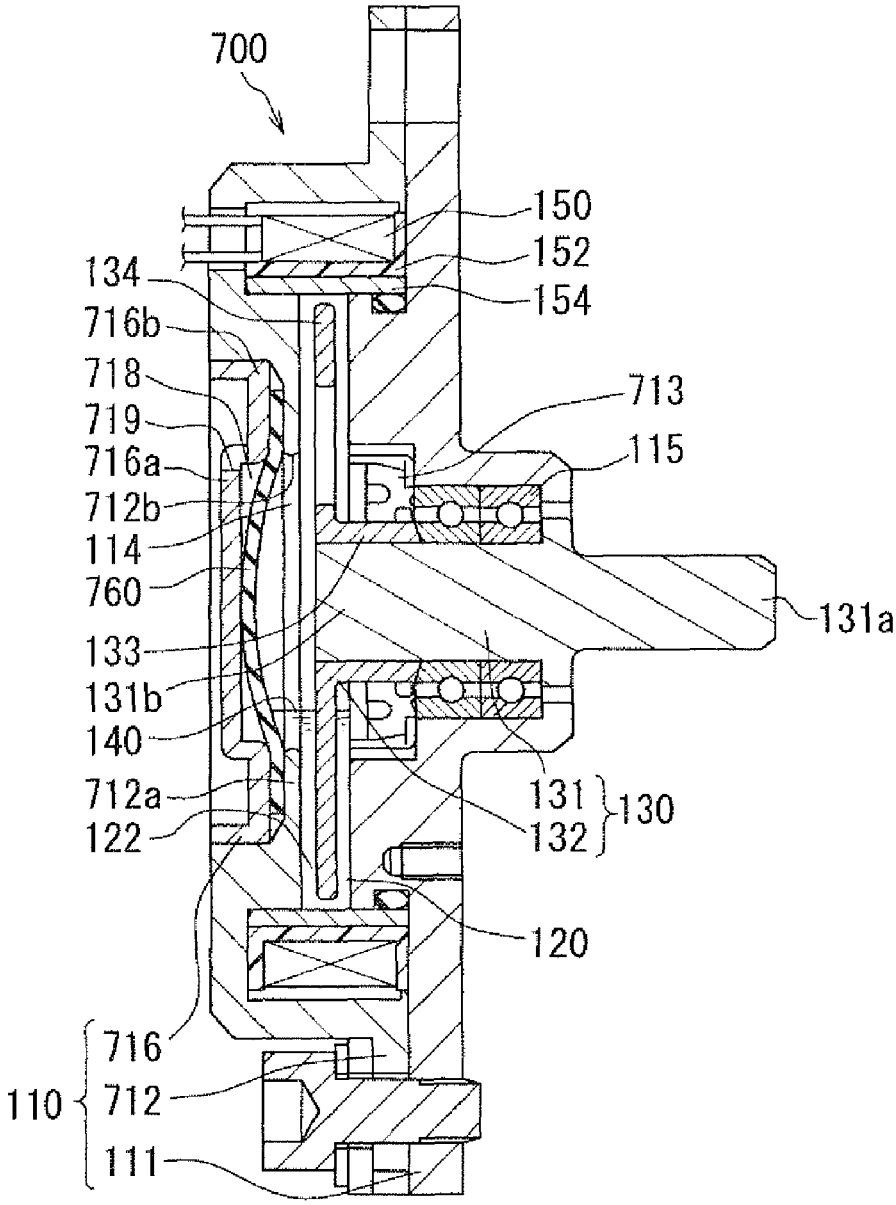
FIG. 15 is a sectional view showing the actuator of the seventh embodiment.

In detail, if a temperature in the fluid chamber 114 increases, the internal pressure of the fluid chamber 114 is increased due to an expansion of air and the MRF 140 in the fluid chamber 114. The pressure difference between the fluid chamber 114 and the open chamber 718 is also increased. As a result, the diaphragm 760 exposed to both chambers 114 and 718 deforms toward the bottom wall 716*a*, and makes air in the open chamber 718 to flow out via the air hole 719. Therefore, the capacity of the fluid chamber 114 is increased, as shown in FIG. 15. As a result, an excessive increase of the internal pressure of the fluid chamber 114 is suppressed. Then, the diaphragm 760 comes in contact with the bottom wall 716*a* as shown in FIG. 15. The bottom wall 716*a* restricts an amount of deformation of the diaphragm 760 within a certain amount. The bottom wall 716*a* may be called as a first restricting member. An initial distance "d" defined between the diaphragm 760 and the bottom wall 716*a* as shown in FIG. 13 is set to permit sufficient deformation of the diaphragm 760 to suppress an excessive pressure change in the fluid chamber 114. The MRF 140 breaks through the sealing device 713 and leaks, when the internal pressure of the fluid chamber 114 exceeds a resisting pressure value of the sealing device 713. In order to prevent such a leakage, the distance "d" is set so that the diaphragm 760 can be deformed to control the internal pressure of the fluid chamber 114 below the above-mentioned resisting pressure value over a predetermined temperature range. Further, the distance "d" is set to prevent the diaphragm 760 from an excessive deformation. The distance "d" is set to restrict the diaphragm 760 to be deformed within a range which does not reach to elastic limits. If the internal pressure of the fluid chamber 114 is decreased in response to a decrease of a temperature, the pressure difference between the fluid chamber 114 and the open chamber 718 is also decreased. The diaphragm 760 returns or deforms toward the rotor 130, i.e., toward a side opposite to the bottom wall 716*a* of the cover 716. Then, air flows into the open chamber 718 via the air holes 719. Therefore, the capacity of the fluid chamber 114 is decreased. As a result, an excessive decrease of the internal pressure of the fluid chamber 114 is suppressed. The capacity or volume of the fluid chamber 114 is varied in an increasing or a decreasing direction by the diaphragm 760 which deforms in response to an internal pressure change in an increasing and a decreasing direction caused by a temperature fluctuation. The elastic deformation of the diaphragm 760 follows correctly and sensitively to the internal pressure change in the fluid chamber 114. The diaphragm 760 is placed in parallel to an end of the case 110 which is formed in a flat shape. The diaphragm 760 has a substantial pressure receiving area which can be defined by the exposing window 712*b* formed widely on the end of the case 110. It is possible to provide relatively large pressure receiving area on the diaphragm 760. As a result, it is possible to provide a large capacity change by a small deformation of the diaphragm 760. According to the embodiment, it is possible to make a fluctuation range of the internal pressure of the fluid chamber 114 small enough. It is possible to avoid deformation of the case 110 and the rotor 130, and to improve durability.

A deformation of the diaphragm 760 is restricted and regulated by the bottom wall 116*a*. The bottom wall 716*a* of the cover 716 has a periphery part where the air holes 719 are formed and a central portion which protects the diaphragm 760 over a great area, i.e., almost all area of the diaphragm 760. Therefore, it is possible to improve durability by protecting the diaphragm 760 from breakage.

The fluid chamber 114 is isolated from the outside air. Therefore, the MRF in the fluid chamber 114 is protected from the outside air. A problem of degrading the MRF 140 by oxidization etc. caused by air introduced into the case 110 is suppressed. Even if the isolation of the fluid chamber 114 becomes insufficient, air in the fluid chamber 114 has smaller flow resistance and leaks more easily from the fluid chamber 114 in comparison with the MRF 140. According to the embodiment, an internal pressure change in the fluid chamber 114 is suppressed. In detail, both an excessively high internal pressure and an excessively low internal pressure can be avoided. As a result, it is possible to suppress a leakage of the MRF 140. The characteristic change resulting from a leakage of the MRF 140 can be suppressed. According to the embodiment, the internal pressure change in the fluid chamber 114 can be suppressed, and the MRF 140 is prevented from degradation. In this embodiment, the internal pressure change of the fluid chamber 114 is suppressed, therefore, it is possible to prevent a leakage of the MRF 140. In addition, the resisting pressure value of the sealing device 713 may be set to a lower value. In this case, since a tightening force of the sealing device 713 can be weakened, it is possible to reduce a friction loss and wearing. In addition, when the braking torque is disappeared or controlled as less as possible, since a rotation loss resulting from the friction of the sealing device 713 can be reduced, it is possible to improve fuel consumption.

According to the embodiment, it is possible to improve both durability and reliability, and to contribute to improve fuel consumption.

Eighth Embodiment

Figure 16:
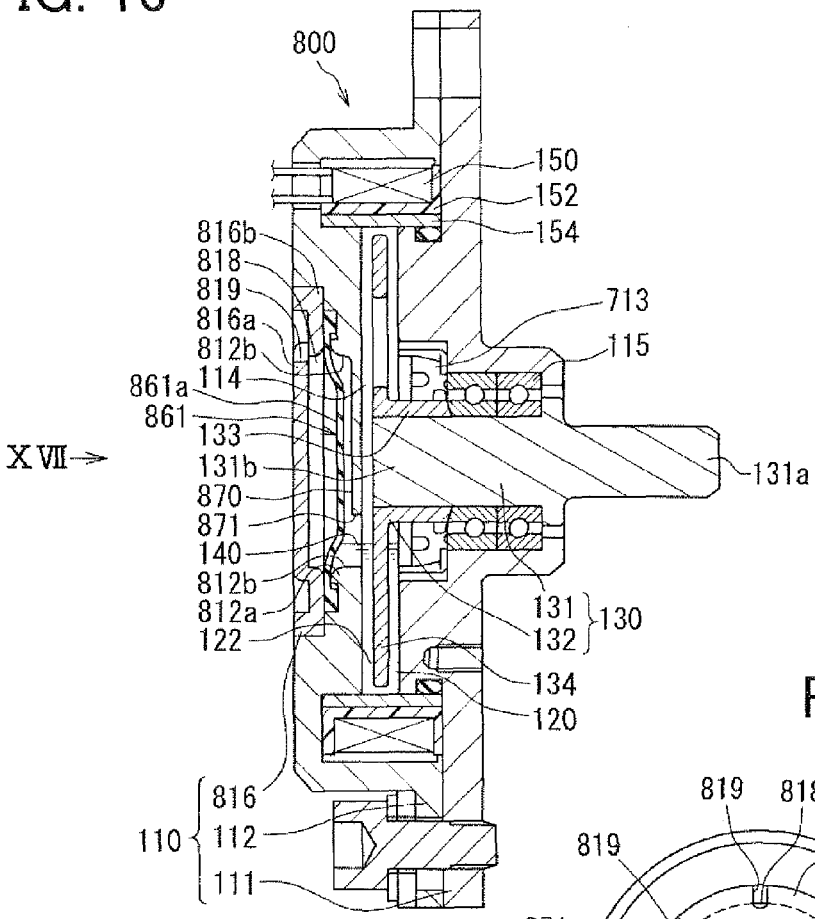
FIG. 16 is a sectional view showing an actuator for a variable valve timing apparatus according to an eighth embodiment of the present invention.
Figure 17:
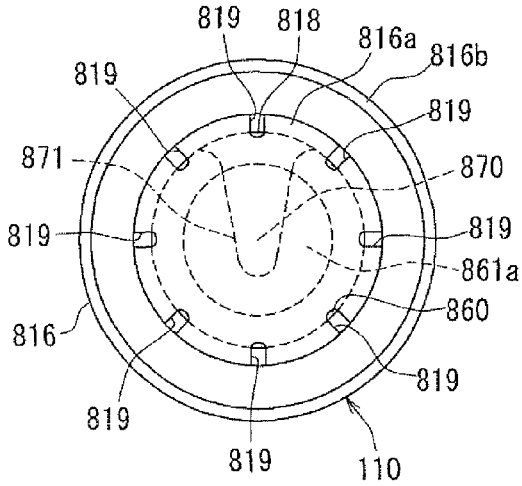
FIG. 17 is a plan view in the arrow XVII in FIG. 16.

As shown in FIG. 16 and FIG. 17, the eighth embodiment is a modification of the seventh embodiment. The actuator 800 in the eighth embodiment is provided with a movement restricting member 870 which restricts the movement of the diaphragm 861 in a direction toward the rotor. The movement restricting member 870 is disposed between the rotor 130 and the diaphragm 861. The movement restricting member 870 is also called as a stopper 870. The diaphragm 861 is made of elastically deformable material. The diaphragm 861 is formed in a dish shape having a circular film shaped bottom 861*a*. The diaphragm 861 is exposed to the fluid chamber 114. The diaphragm 861 is coaxially arranged on the case 110. The diaphragm 861 is attached on an outside surface of the bottom wall 812*a* of the second housing 812. The diaphragm 861 is placed on a side of the bottom wall 812*a* opposite to the first housing 111. The diaphragm 861 has an outer peripheral part outwardly extending from the bottom 861*a*. The diaphragm 861 is supported by the outer peripheral part. The outer peripheral part of the diaphragm 861 is pinched between the surrounding portion of the exposing window 812*b* and the flange part 816*b* of the cover 816. The fluid chamber 114 is defined by the first housing 111, the second housing 812 and the diaphragm 861. The diaphragm 861 isolates the fluid chamber 114 from the outside air. The diaphragm 861 deforms and moves according to the pressure difference between the internal pressure of the open chamber 818 substantially maintained at the atmospheric pressure and the internal pressure of the fluid chamber 114. The diaphragm 861 has an initial shape as shown in FIG. 16. In detail, the diaphragm 861 is formed to place the periphery part of the diaphragm 861 closer to the cover 816 than the bottom 861*a* when both the internal pressures in the fluid chamber 114 and the open chamber 818 are almost equal. In other word, the diaphragm 861 is formed in a slightly protruded shape to place the bottom 861*a* close to the stopper 870. Therefore, the periphery part of the diaphragm 861 is formed in a funnel shape. The diaphragm 861 is made of the same material as the diaphragm 760.

The stopper 870 is formed in a part of the second housing 812. The stopper 870 is a thin strip which is prolonged from an annular board shaped bottom wall portion 812*a* toward a radial inside direction. The stopper 870 is formed substantially in parallel with the bottom 861*a* of the diaphragm 861. The stopper 870 is a member which crosses the fluid chamber 114 on a plane perpendicular to the axial direction of the rotor 130. The stopper 870 incompletely partitions the fluid chamber 114 into two volumes in the axial direction of the rotor 130. The volumes are placed on both sides of the stopper 870 respectively, and are formed as a rotor side volume of the fluid chamber 114 and a diaphragm side volume of the fluid chamber 114, respectively. The stopper 870 is placed so that the stopper 870 is distanced from the bottom 861*a* by a predetermined distance, when the diaphragm 861 is in an unloaded condition, i.e., a free position.

As shown in FIG. 17, the stopper 870 is arranged to overlap with at least a radially center section of the diaphragm 861. The center section of the diaphragm 861 is understood as a part which is in the most distant location in a radially inside direction from the periphery part of the diaphragm 861. The center section of the diaphragm 861 is obtained as the central part of a circle, in a case that the diaphragm 861 is a circle configuration. The center section of the diaphragm 861 is obtained as an intersection portion of diagonal lines, in a case that the diaphragm 861 is a polygonal shape, such as a quadrangle. When the center section of the diaphragm 861 is deformed toward the rotor, the deformation is restricted by making the diaphragm 861 come into contact with the stopper 870. The stopper 870 is prolonged from the bottom wall portion 812*a* in the shape of a tongue to the center section of the diaphragm 861 at least. The aperture of C shape is formed between the peripheral edge part 871 of the stopper 870 and the bottom wall portion 812*a*. An aperture constructs a communicating passage which communicates the volumes of the fluid chamber 114 on both sides of the stopper 870.

The cover 816 is preferably made of material which has higher heat conductivity than the second housing 812. The heat conductivity is defined as a value obtained by dividing a heat quantity transmitted during a unit time through a unit area perpendicular to the heat flow direction with a temperature gradient on a unit length. In other word, the material for the cover 816 is selected so that the cover 816 allows a greater amount of a heat quantity per unit time transmitted through a unit area perpendicular to a heat flow direction resulting from a temperature gradient on a unit length than that on the second housing 812. Therefore, the heat from the fluid chamber is easier to flow through the cover 816 than the second housing 812. The second housing 812 is made of iron material, such as low-carbon steel, e.g., S10C, in order to form the magnetic circuit. Then, the cover 816 can be made of material having higher heat conductivity than the iron material. For example, aluminum, magnesium, copper, and alloy of them, etc. can be used. The cover 816 is relatively easy to be cooled, therefore, becomes relatively low temperature. Even if the diaphragm 861 comes in contact with the cover 816 at a high temperature condition, it is possible to prevent the diaphragm 861 from degradation caused by the high temperature. As a result, it is possible to maintain the function of the diaphragm 861 over a long period of time.

If an internal pressure of the fluid chamber 114 is increased in response to an increase of a temperature, the diaphragm 861 expands toward the bottom wall 816*a*. As a result, an excessive increase of the internal pressure of the fluid chamber 114 is suppressed. Then, the diaphragm 961 comes in contact with the bottom wall 816*a*. The bottom wall 816*a* restricts an amount of deformation of the diaphragm 861 within a certain amount. If the internal pressure of the fluid chamber 114 is decreased in response to a decrease of a temperature, the diaphragm 861 returns to the opposite side and decreases the capacity of the fluid chamber 114. Then, the diaphragm 861 comes in contact with the stopper 870 which is placed between the diaphragm 861 and the rotor 130. The stopper 870 restricts an amount of deformation of the diaphragm 861 within a range which does not reach an elastic limit. In addition, the diaphragm 861 is protected from the rotor 130. The diaphragm 861 is protected by the stopper 870 from the rotor 130 and is protected by the bottom wall 816*a* from the outside over a wide area. According to the embodiment, it is possible to improve durability of the diaphragm 861 by protecting the diaphragm 861 from a breakage caused by an excessive elastic deformation or wearing.

According to the embodiment, it is possible to improve both durability and reliability, and to contribute to improve fuel consumption. The stopper 870 is arranged to overlap with at least a radially center section of the diaphragm 861. It is possible to restrict the deformation of the diaphragm 861.

Ninth Embodiment

Figure 18:
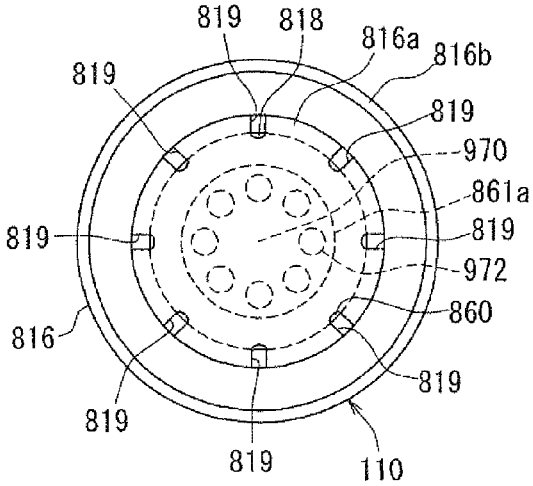
FIG. 18 is a plan view showing a part of an actuator for a variable valve timing apparatus according to a ninth embodiment of the present invention.

FIG. 18 is a sectional view showing a ninth embodiment that is a modification of the eighth embodiment. The stopper 970 is a thin-strip member of the circle configuration which forms the cross section which extends toward an inner direction from the bottom wall 812*a*, and intersects the fluid chamber 114 perpendicularly with the shaft orientations of the rotor 130. The stopper 970 is formed in a part of the second housing 812. The stopper 970 is formed with a plurality of communication holes 972 penetrating in the thickness direction. The communication holes 972 are arranged at equal intervals. The communication holes 972 provide communicating passages which communicates the volumes of the fluid chamber 114 on both sides of the stopper 970. The communication hole 972 is not formed on an area which overlaps with and comes in contact with a center portion of the diaphragm 861. The deformation of the diaphragm 861 is restricted by making the center portion of the diaphragm 861 to come in contact with the area where no communication hole 972 is formed.

Tenth Embodiment

Figure 19:
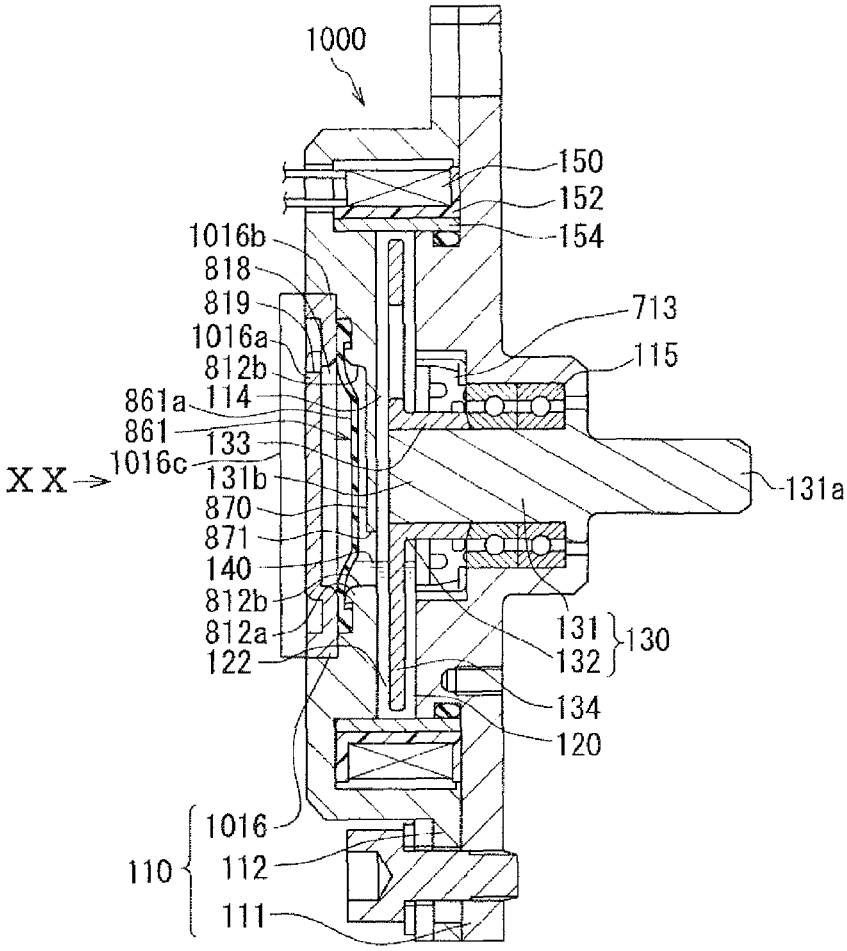
FIG. 19 is a sectional view showing an actuator for a variable valve timing apparatus according to a tenth embodiment of the present invention.
Figure 20:
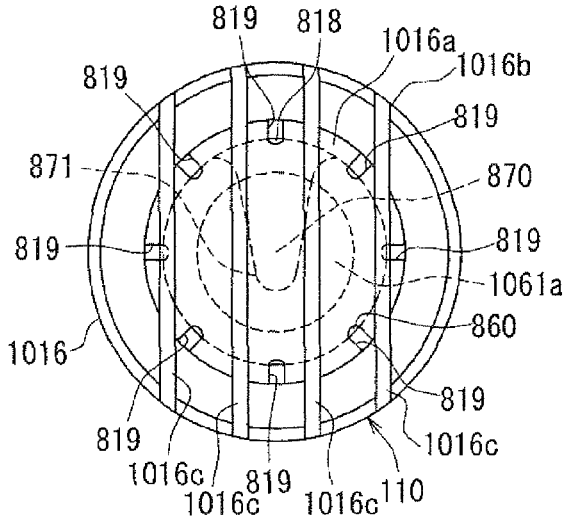
FIG. 20 is a plan view in the arrow XX in FIG. 19.

FIG. 19 is a sectional view showing a tenth embodiment that is a modification of the eighth embodiment. FIG. 20 is a plan view of a cover. An actuator 1000 in the tenth embodiment has a cover 1016. The cover 1016 has a heat exchanging portion which facilitates heat radiation from the cover 1016. The portion is provided by at least one fin 1016*c*. The cover 1016 has a plurality of fins 1016*c*. Each of the fins 1016*c* is formed in a plate shape protruding in the axial direction by a predetermined height from an external surface of both a bottom wall portion 1016*a* and a flange portion 1016*b*. The fins 1016*c* are formed in a rail-like shape crossing on the external surface. The fins 1016*c* are arranged in parallel with equal intervals. The fins 1016*c* may be made of any material. The fins 1016*c* are made of material which can receives heat from the cover 1016 with less heat lost. The fins 1016*c* may be made of the same material as the cover 1016. The fin 1016*c* increases a surface area of the cover for performing heat exchange with air. The fin 1016*c* radiates the heat in the open chamber 818 to air. The heat in the open chamber 818 conducts the cover 1016 and is positively radiated to air from the fins 1016*c*. Especially, when the diaphragm 861 touches on the bottom wall portion 116*a*, the heat of the diaphragm 861 is directly conducted to the cover 1016, and is radiated to air. Thereby, cooling of the diaphragm 861 is promoted. The fins 1016*c* are not limited to the rail shape, any shape which can increase the surface area of the cover 1016 may be used. For example, the fins may be formed in a lattice shape or an annular shape. The covering 1016 may be made of material which has higher heat conductivity than the second housing 112. This material can be used in addition to the fins 1016*c*. It is possible to further facilitate heat conduction from the diaphragm 861 to the cover 1016.

Eleventh Embodiment

Figure 21:
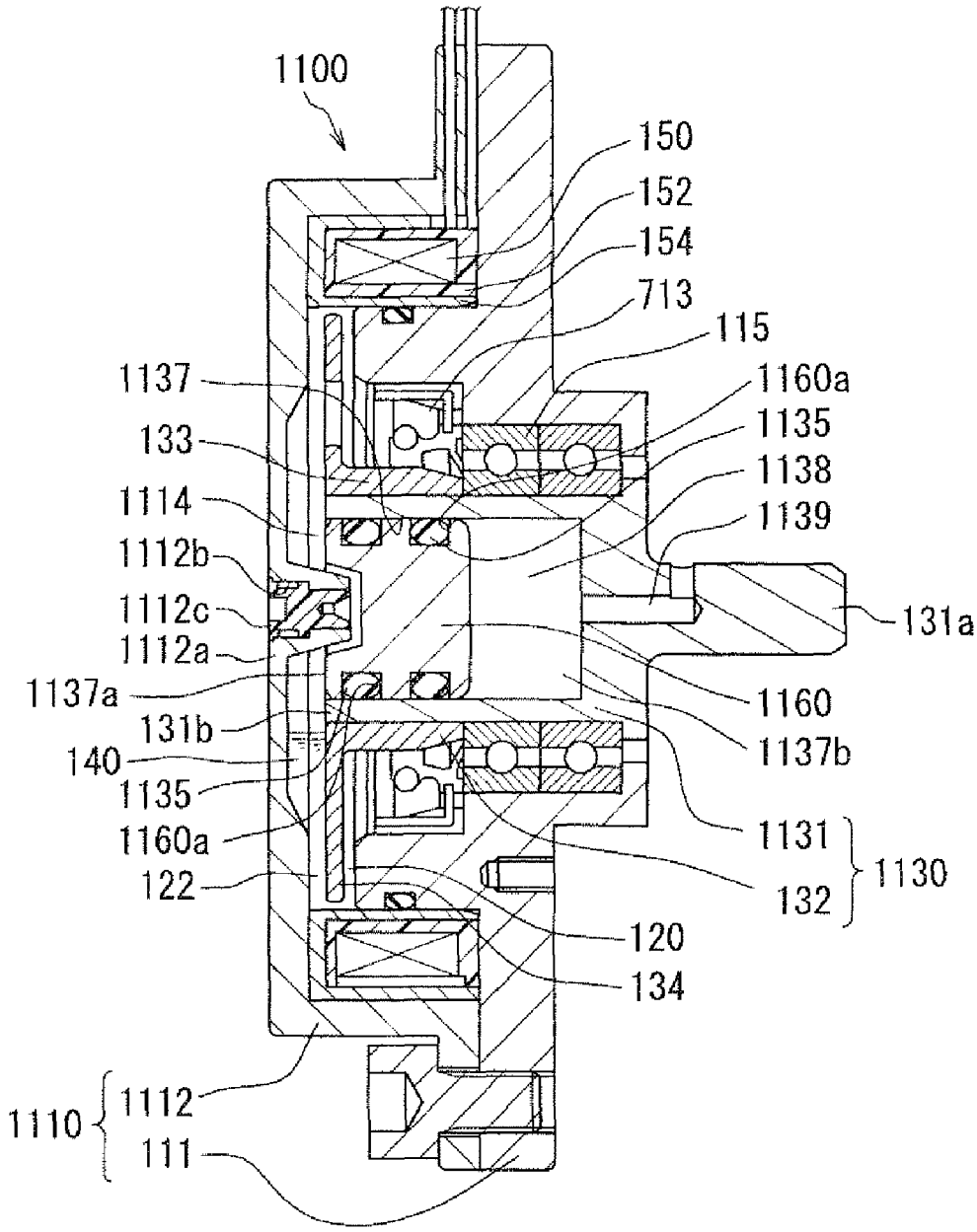
FIG. 21 is a sectional view showing an actuator for a variable valve timing apparatus according to an eleventh embodiment of the present invention.
Figure 22:
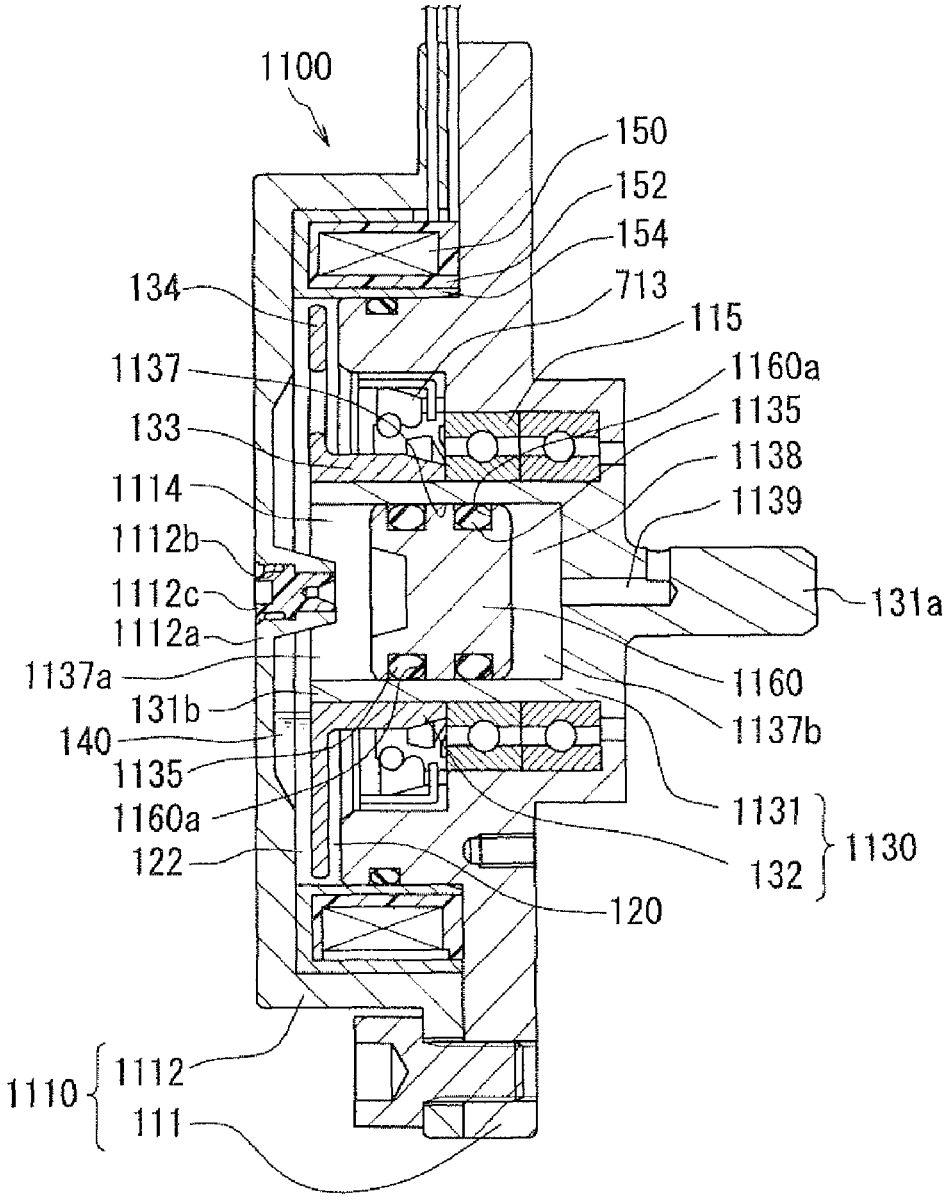
FIG. 22 is a sectional view showing an actuator for a variable valve timing apparatus according to the eleventh embodiment of the present invention.

FIG. 21 and FIG. 22 are sectional drawings showing an actuator of an eleventh embodiment of the present invention. The same reference numbers as the preceding embodiments are used for indicating the same or corresponding components. The preceding descriptions may be referred for the portions denoted by the same reference numbers. The eleventh embodiment can be regarded as a modification of the seventh embodiment. An actuator 1100 in the eleventh embodiment is provided with a piston type pressure control mechanism instead of the diaphragm type pressure control mechanism described in the preceding embodiments. The actuator 1100 has a case 1110. The case 1110 is provided with the first housing 111 and the second housing 1112. An aperture 1112*b* is formed on a bottom wall portion 1112*a* of the second housing 1112. A cap 1112*c* is press fitted in the aperture 1112*b*. A fluid chamber 1114 is defined between the first housing 111 and the second housing 1112. The fluid chamber 1114 forms the magnetic gaps 120 and 122. The actuator 1100 has a structure for supporting a piston 1160 by a shaft 1131 of a rotor 1130.

The shaft 1131 is made of metal and is engaged with the phase adjusting mechanism 300. The shaft 1131 is generally formed in a cylindrical shape with a bottom wall. The inner bore of the shaft provides a cylinder bore 1137 which is formed coaxially with the shaft and extends along the axis of the shaft 1137. The cylinder bore 1137 may be called as a cylindrical bore with a bottom surface. The bottom wall of the shaft 1131 is placed on an end where the shaft 1131 is engaged with the phase adjusting mechanism 300. The cylinder bore 1137 has an opening end 1137*a* which opens at one end of the shaft 1131. The opening end 1137*a* is placed to open to the fluid chamber 1114. The shaft 1131 is further formed with an air hole 1139 which is a circular cross section passage formed in a L-shape. One end of the air hole 1139 is opened on an inner surface of the cylinder bore 1137 at a position close to a bottom wall 1137*b* which is on an opposite end to the opening end 1137*a*. The other end of the air hole

1139 is opened on an outer surface of the shaft 1131 at a position placed outside the case 1110.

The piston 1160 is formed in a columnar shape and is made of metal. The piston 1160 is placed in the cylinder bore 1137 in a reciprocally movable manner. The piston 1160 is supported in the shaft 1131. The piston 1160 is movable in the axial direction in a sliding manner. A part of the cylinder bore 1137 defined on a side closer to the opening end 1137*a* than the piston 1160 provides a part of the fluid chamber 1114 where the MRF 140 is partially contained with air. Therefore, the piston 1160 is exposed to the fluid chamber 1114. On the other hand, a part of the cylinder bore 1137 defined on a side closer to the bottom wall 1137*b* than the piston 1160 provides an open chamber 1138 which is communicated with the atmosphere via the air hole 1139. The piston 1160 is exposed to the open chamber 1138. The open chamber 1138 is maintained at the atmospheric pressure since the air hole 1139 introduces air from the atmosphere. The piston 1160 is formed with a plurality of annular grooves 1160*a*. The annular grooves 1160*a* extend in a circumferential direction continuously and open in a radial outside direction. The annular grooves 1160*a* hold a plurality of O rings 1135 respectively. The O ring 1135 is formed in an annular shape and is made of rubber. These O rings 1135 provide seals in a gap between the piston 1160 and the cylinder bore 1137. Therefore, the piston 1160 and the O rings 1135 isolate the fluid chamber 1114 from the open chamber 1138, i.e., the outside of the case 1110.

The piston 1160 reciprocates according to a pressure difference between the fluid chamber 1114 and the open chamber 1138. If an internal pressure of the fluid chamber 1114 is increased in response to an increase of a temperature, the pressure difference between the fluid chamber 1114 and the open chamber 1138 is also increased. As a result, the piston 1160 exposed to both chambers 1114 and 1138 moves in the cylinder bore 1137 toward the bottom wall 1137*b* and makes air to flow out from the open chamber 1138 via the air hole 1139. Therefore, the capacity of the fluid chamber 1114 is increased and excessive increase of the internal pressure of the fluid chamber 1114 is suppressed. FIG. 22 shows a condition where the capacity of the fluid chamber 1114 is expanded. If the internal pressure of the fluid chamber 1114 is decreased in response to a decrease of a temperature, the pressure difference between the fluid chamber 1114 and the open chamber 1138 is also decreased. As a result, the piston 1160 exposed to both chambers 1114 and 1138 moves in the cylinder bore 1137 toward the opening end 1137*a* and makes air to flow into the open chamber 1138 via the air hole 1139. Therefore, the capacity of the fluid chamber 1114 is decreased and the internal pressure of the fluid chamber 1114 is maintained to keep certain relationship with the atmospheric-pressure. FIG. 21 shows a condition where the capacity of the fluid chamber 1114 is decreased. It is possible to form a sufficiently long moving stroke of the piston 1160 along the axial direction, i.e., a penetrating direction.

Therefore, it is possible to improve both durability and reliability. The piston 1160 corresponds to the movable member, and the O ring 1135 corresponds to the seal member. The shaft 1131 and the boss part 133 form the shaft jointly.

Other Embodiment

As mentioned above, although a plurality of embodiments of the present invention has been described, the present invention shall not be interpreted within those embodiments, and can be applied to various embodiments without a deviation from an outline.

The radial distances defined by the guide gaps on the flux guides may be set in different distances. For example, the flux guides may be formed to set different radial distances each other. For example, the flux guides may be formed so that the radial distances are gradually increased as it approaches to the outside of the case. For example, the most outside radial distance is set greatest among the radial distances. Although the flux guides are arranged next to the magnet on a side close to the rotor, i.e., close to the inside of the case, the flux guides may be arranged next to the magnet on a side close to the bearing, i.e., close to the outside of the case. Number of the flux guides may be set to any number more than two. Number of the flux guides may be set to satisfy several requirements.

The nonmagnetic ring 663 may be disposed in any axial gap where two components magnetized in opposite polarities. For example, the nonmagnetic ring 663 may be disposed in an axial gap which is formed on an inside or an outside of the magnet and between two components disposed on both sides of the magnet. In one of the embodiment, the nonmagnetic ring may be disposed between the flux guide and the bearing. In one of the embodiment, the nonmagnetic ring 663 may be disposed between the flux guides 164*b* and 564*c*.

The MRF 140 may be contained to fill up the fluid chamber. An internal pressure adjustment mechanism may be constructed by a diaphragm disposed on the shaft 1131 instead of the piston 1160. The piston 1160 may be disposed on the second housing in a movable manner to provide an internal pressure adjustment mechanism.

The stopper may be provided by a wall which is located on a position to oppose to and is able to come in contact with the center part of the diaphragm. The communicating passage formed in relation to the stopper is not limited to a shape shown in the embodiments. The shape of the communication hole is not limited to a circular shape. The communication hole may be formed in a rectangular shape. The communication hole may be formed as a single hole.

The phase adjusting mechanism 300 may be installed on the engine to engage the rotor 10 with a camshaft, and to engage the rotor 20 with a crankshaft. The phase adjusting mechanism 300 is not limited to the illustrated configuration. The phase adjusting mechanism 300 is a mechanism which can adjust the engine phase according to a relative rotational condition of the rotor 130 or 530 with respect to the rotor 10. The phase adjusting mechanism 300 may include the planetary gear mechanism, i.e., the differential gear mechanism, having an arrangement different from the embodiment.

Although the present invention is applied to an intake valve operating apparatus in the embodiments, the present invention may be applied to an apparatus for operating an exhaust valve or an apparatus for operating both the intake and the exhaust valves.

Although the present invention has been fully described in connection with the preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A variable valve timing apparatus for adjusting valve timing of a valve which is opened and closed by a camshaft driven by torque transmission from a crankshaft in an internal combustion engine, the apparatus comprising:

a case defining a fluid chamber inside;

magneto-rheological fluid kept in the fluid chamber, the magneto-rheological fluid having a viscosity variable in accordance with magnetic flux passing through;

a control device which carries out variable control of the viscosity of the magneto-rheological fluid by varying the magnetic flux;

a rotor rotatably supported on the case and penetrated the case to come into contact with the magneto-rheological fluid so that the rotor receives a braking torque according to the viscosity of the magneto-rheological fluid;

an angular phase adjusting mechanism engaged with the rotor at an outside of the case for adjusting an angular phase difference between the crankshaft and the camshaft according to the braking torque acting on the rotor; and a sealing device provided between the case and the rotor, wherein the sealing device comprising:

a magnet supported on one of the case and the rotor for supplying magnetic flux;

a plurality of flux guides supported on one of the case and the rotor and annularly arranged along the rotational direction of the rotor for defining a plurality of guide gaps with the other one of the case and the rotor, and for guiding the magnetic flux to the guide gaps, the guide gaps being arranged in a multi row fashion between an inside and an outside of the case; and further comprising:

a nonmagnetic shield member for covering the sealing device in the case, wherein the distances of the guide gaps are smaller than a thickness of the nonmagnetic shield member.

2. The variable valve timing adjusting apparatus claimed in claim 1, wherein the flux guides and the magnet are supported on the case fixed on an internal combustion engine, and the guide gaps are defined between the flux guides and the rotor.

3. The variable valve timing apparatus claimed in claim 1, wherein the rotor is supported on a bearing disposed on the case at a position closer to the outside of the case than the sealing device.

4. The variable valve timing apparatus claimed in claim 1, wherein the nonmagnetic shield member has an exposed portion exposed to the fluid chamber, and wherein the distances of the guide gaps are smaller than a thickness of the exposed portion of the nonmagnetic shield member.

5. The variable valve timing apparatus claimed in claim 1, wherein the flux guides are arranged on one side of the magnet with respect to an axial direction.

6. The variable valve timing apparatus claimed in claim 5, wherein the case has a magnetic yoke portion for conducting the magnetic flux at a position opposite to the flux guides with respect to the magnet in the axial direction.

7. The variable valve timing apparatus claimed in claim 5, wherein distances of the guide gaps are equal to each other.

8. The variable valve timing apparatus claimed in claim 5, wherein the case has a bearing which supports the rotor and is located on a position closer to an outside of the case than the sealing device, and wherein the flux guides are arranged on an opposite side to the bearing with respect to the magnet.

9. The variable valve timing apparatus claimed in claim 1, wherein the flux guides are arranged on both sides of the magnet in the axial direction.

10. The variable valve timing apparatus claimed in claim 9, wherein the guide gap arranged on a portion closer to an outside of the case than the magnet defines a first distance, the guide gap arranged on a portion closer to an inside of the case than the magnet defines a second distance, and the first distance is smaller than the second distance.

11. The variable valve timing apparatus claimed in claim 9, wherein the other one of the case and the rotor has a protruded portion which is located between the flux guides arranged on both sides of the magnet.

12. The variable valve timing apparatus claimed in claim 11, wherein the protruded portion has a height that is greater than a distance of the guide gap defined by the flux guide arranged on the side of the magnet closer to the outside of the case.

13. The variable valve timing apparatus claimed in claim 9, wherein the case has a bearing which supports the rotor and is located on a position closer to an outside of the case than the sealing device, and wherein the flux guide arranged on the side of the magnet closer to the outside of the case defines an axial gap between itself and the bearing.

14. The variable valve timing apparatus claimed in claim 1, wherein at least one of the flux guide and a boss part of the rotor defines a guide gap with uneven radial distances which is varied along a direction from an inside to an outside of the case.

15. The variable valve timing apparatus claimed in claim 14, wherein the flux guide has a radial inside portion which is branched into a plurality of guide projections project toward the boss part, the boss part has a plurality of boss projections which are formed to project toward corresponding guide projections, and the guide projections and the boss projections define narrow parts of the guide gap therebetween.

16. The variable valve timing apparatus claimed in claim 1, wherein the rotor has a boss part which has an outer surface formed with an annular shaped boss projection facing to an inner surface of the flux guide, the boss projection having an inclined surface on a side close to the phase adjusting mechanism.

17. The variable valve timing apparatus claimed in claim 1, wherein the plurality of the flux guides includes at least two flux guides of identical shape.

18. The variable valve timing apparatus claimed in claim 1, wherein the case has a bearing which supports the rotor and is located on a position closer to an outside of the case than the sealing device, and wherein the case includes a contact part which is disposed between the bearing and the sealing device and is located to come in contact with the bearing in an axial direction, and wherein the contact part and the boss part define another guide gap for guiding the magnetic flux of the magnet between an inner surface of the contact part and an outer surface of the boss part.

19. The variable valve timing apparatus claimed in claim 1, wherein the case has a magnetic yoke portion disposed on a side of the magnet opposite to the flux guides for passing the magnetic flux of the magnet, and wherein the variable valve timing apparatus further comprises a nonmagnetic member in an annular gap formed on a radial inside or a radial outside to the magnet and between the flux guides and the magnetic yoke portion.

20. The variable valve timing apparatus claimed in claim 1, further comprising a nonmagnetic member in an annular gap formed on a radial inside or a radial outside to the magnet and between the flux guides on both sides of the magnets.

21. A variable valve timing apparatus for adjusting valve timing of a valve which is opened and closed by a camshaft driven by torque transmission from a crankshaft in an internal combustion engine, the apparatus comprising:

a case defining a fluid chamber inside;

magneto-rheological fluid kept in the fluid chamber, the magneto-rheological fluid having a viscosity variable in accordance with magnetic flux passing through;

a control device which carries out variable control of the viscosity of the magneto-rheological fluid by varying the magnetic flux;

a rotor rotatably supported on the case and penetrated the case to come into contact with the magneto-rheological fluid so that the rotor receives a braking torque according to the viscosity of the magneto-rheological fluid;

an angular phase adjusting mechanism engaged with the rotor at an outside of the case for adjusting an angular phase difference between the crankshaft and the camshaft according to the braking torque acting on the rotor; and a sealing device provided between the case and the rotor, wherein the sealing device comprising:

a magnet supported on one of the case and the rotor for supplying magnetic flux;

a plurality of flux guides supported on one of the case and the rotor and annularly arranged along the rotational direction of the rotor for defining a plurality of guide gaps with the other one of the case and the rotor, and for guiding the magnetic flux to the guide gaps, the guide gaps being arranged in a multi row fashion between an inside and an outside of the case, wherein the flux guides are arranged on both sides of the magnet in the axial direction, and wherein the guide gap arranged on a portion closer to an outside of the case than the magnet defines a first distance, the guide gap arranged on a portion closer to an inside of the case than the magnet defines a second distance, and the first distance is smaller than the second distance.

22. The variable valve timing apparatus claimed in claim 21, wherein the other one of the case and the rotor has a protruded portion which is located between the flux guides arranged on both sides of the magnet.

23. The variable valve timing apparatus claimed in claim 22, wherein the protruded portion has a height that is greater than a distance of the guide gap defined by the flux guide arranged on the side of the magnet closer to the outside of the case.

24. A variable valve timing apparatus for adjusting valve timing of a valve which is opened and closed by a camshaft driven by torque transmission from a crankshaft in an internal combustion engine, the apparatus comprising:

a case defining a fluid chamber inside;

magneto-rheological fluid kept in the fluid chamber, the magneto-rheological fluid having a viscosity variable in accordance with magnetic flux passing through;

a control device which carries out variable control of the viscosity of the magneto-rheological fluid by varying the magnetic flux;

a rotor rotatably supported on the case and penetrated the case to come into contact with the magneto-rheological fluid so that the rotor receives a braking torque according to the viscosity of the magneto-rheological fluid;

an angular phase adjusting mechanism engaged with the rotor at an outside of the case for adjusting an angular phase difference between the crankshaft and the camshaft according to the braking torque acting on the rotor; and a sealing device provided between the case and the rotor, wherein the sealing device comprising:

a magnet supported on one of the case and the rotor for supplying magnetic flux;

a plurality of flux guides supported on one of the case and the rotor and annularly arranged along the rotational direction of the rotor for defining a plurality of guide gaps with the other one of the case and the rotor, and for guiding the magnetic flux to the guide gaps, the guide gaps being arranged in a multi row fashion between an inside and an outside of the case, wherein the flux guides are arranged on both sides of the magnet in the axial direction, and wherein the case has a bearing which supports the rotor and is located on a position closer to an outside of the case than the sealing device, and wherein the flux guide arranged on the side of the magnet closer to the outside of the case defines an axial gap between itself and the bearing.

25. A variable valve timing apparatus for adjusting valve timing of a valve which is opened and closed by a camshaft driven by torque transmission from a crankshaft in an internal combustion engine, the apparatus comprising:

a case defining a fluid chamber inside;

magneto-rheological fluid kept in the fluid chamber, the magneto-rheological fluid having a viscosity variable in accordance with magnetic flux passing through;

a control device which carries out variable control of the viscosity of the magneto-rheological fluid by varying the magnetic flux;

a rotor rotatably supported on the case and penetrated the case to come into contact with the magneto-rheological fluid so that the rotor receives a braking torque according to the viscosity of the magneto-rheological fluid;

an angular phase adjusting mechanism engaged with the rotor at an outside of the case for adjusting an angular phase difference between the crankshaft and the camshaft according to the braking torque acting on the rotor; and a sealing device provided between the case and the rotor, wherein the sealing device comprising:

a magnet supported on one of the case and the rotor for supplying magnetic flux;

a plurality of flux guides supported on one of the case and the rotor and annularly arranged along the rotational direction of the rotor for defining a plurality of guide gaps with the other one of the case and the rotor, and for guiding the magnetic flux to the guide gaps, the guide gaps being arranged in a multi row fashion between an inside and an outside of the case, wherein the case has a magnetic yoke portion disposed on a side of the magnet opposite to the flux guides for passing the magnetic flux of the magnet, and wherein the variable valve timing apparatus further comprises a nonmagnetic member in an annular gap formed on a radial inside or a radial outside to the magnet and between the flux guides and the magnetic yoke portion.

* * * * *